US007843476B2

(12) United States Patent
Morikawa et al.

(10) Patent No.: US 7,843,476 B2
(45) Date of Patent: Nov. 30, 2010

(54) THERMAL HEAD AND PRINTER

(75) Inventors: Tooru Morikawa, Kanagawa (JP); Izumi Kariya, Kanagawa (JP); Noboru Koyama, Tokyo (JP); Mitsuo Yanase, Kanagawa (JP)

(73) Assignee: Sony Corporation, Tokyo (JP)

( * ) Notice: Subject to any disclaimer, the term of this patent is extended or adjusted under 35 U.S.C. 154(b) by 634 days.

(21) Appl. No.: 11/682,606

(22) Filed: Mar. 6, 2007

(65) Prior Publication Data

US 2008/0143810 A1 Jun. 19, 2008

(30) Foreign Application Priority Data

Mar. 17, 2006 (JP) ..... P2006-075628
Mar. 17, 2006 (JP) ..... P2006-075636

(51) Int. Cl.
*B41J 2/34* (2006.01)

(52) U.S. Cl. ..... 347/209; 347/200; 347/206

(58) Field of Classification Search ..... 347/209, 347/208, 204–206, 200
See application file for complete search history.

(56) References Cited

U.S. PATENT DOCUMENTS

| | | | | |
|---|---|---|---|---|
| 6,335,750 | B2 * | 1/2002 | Horiuchi et al. | 347/200 |
| 6,525,755 | B1 * | 2/2003 | Imai et al. | 347/208 |
| 2001/0033320 | A1 * | 10/2001 | Sugiyama et al. | 347/206 |

FOREIGN PATENT DOCUMENTS

| | | | |
|---|---|---|---|
| DE | 3435407 | | 3/2010 |
| EP | 1 077 135 | | 2/2001 |
| EP | 1 403 075 | | 3/2001 |
| EP | 1 582 359 | | 10/2005 |
| JP | 01-080433 | | 3/1989 |
| JP | 020425163 | * | 2/1990 |
| JP | 04-152642 | | 5/1992 |
| JP | 05-016408 | | 1/1993 |
| JP | 05-270030 | | 10/1993 |
| JP | 07-014859 | | 1/1995 |
| JP | 08-090815 | | 4/1996 |
| JP | 08-090915 | | 4/1996 |
| JP | 08-216443 | | 8/1996 |
| JP | 10-138541 | | 5/1998 |
| JP | 2002-307732 | | 10/2002 |
| JP | 2004-175085 | | 6/2004 |
| JP | 2006-035836 | | 2/2006 |

OTHER PUBLICATIONS

Japanese Patent Office Action corresponding to Japanese Serial No. 2006-075636 dated Jan. 12, 2010.
Japanese Patent Office Actions corresponding to Japanese Serial No. 2006-075636 dated Oct. 20, 2009.
European Search Report dated Feb. 8, 2010.

* cited by examiner

*Primary Examiner*—K. Feggins
(74) *Attorney, Agent, or Firm*—SNR Denton US LLP

(57) ABSTRACT

A thermal head includes a head containing a glass layer. The glass layer has a projecting portion on one surface and a concave groove on the other surface at a position opposed to the projecting portion. The head further contains a heating resistor disposed on the projecting portion, and a pair of electrodes disposed on both sides of the heating resistor. The thermal head further includes a rigid substrate on which a control circuit for the head is provided, and a flexible substrate for electrically connecting the head and the rigid substrate.

6 Claims, 20 Drawing Sheets

THERMAL HEAD AND PRINTER

CROSS REFERENCES TO RELATED APPLICATIONS

The present invention contains subject matter related to Japanese Patent Applications JP 2006-075628 and JP 2006-075636 both filed in the Japanese Patent Office on Mar. 17, 2006, the entire contents of which being incorporated herein by reference.

BACKGROUND OF THE INVENTION

1. Field of the Invention

The invention relates to a thermal head which thermally transfers color material of an ink ribbon onto a printing medium, and a printer including the thermal head.

2. Description of the Related Art

As a printer for printing images and characters on a printing medium, such a thermal transfer type printer (hereinafter referred to as printer) is known which sublimates color material of an ink layer formed on one surface of an ink ribbon and thermally transfers the color material onto a printing medium to print color images and characters thereon. This type of printer includes a thermal head for thermally transferring the color material of the ink ribbon onto the printing medium, and a platen disposed at a position opposed to the thermal head to support the ink ribbon and the printing medium.

In this printer, the ink ribbon disposed on the thermal head side and the printing medium on the platen side overlap with each other. The ink ribbon and the printing medium move between the thermal head and the platen while being pressed onto the thermal head by the platen. During this period, the printer applies thermal energy to the ink layer from the back surface of the ink ribbon by using the thermal head and sublimates the color material through utilization of the thermal energy, thereby thermally transferring the color material onto the printing medium and printing color images and characters thereon.

According to this thermal transfer type printer, the power consumption of the printer is large since prompt increase of the temperature of the thermal head by heating is necessary at the time of high-speed printing. It is therefore difficult, particularly for a household printer, to increase the printing speed while saving power. For achieving high-speed printing by the household thermal transfer type printer, it is necessary to increase thermal efficiency of the thermal head while decreasing power consumption.

A thermal head 100 shown in FIG. 20 is an example of a thermal head included in a thermal transfer type printer in related art. The thermal head 100 has a glass layer 102 on a ceramic substrate 101, and a heating resistor 103, a pair of electrodes 104*a* and 104*b* for causing the heating resistor 103 to generate heat, and a protection layer 105 for protecting the heating resistor 103 and the electrodes 104*a* and 104*b* in this order. According to the structure of the thermal head 100, an area exposed between the pair of the electrodes 104*a* and 104*b* becomes a heating area 103*a* which generates heat. The glass layer 102 is substantially circular-arc-shaped so that the heating area 103*a* can be opposed to an ink ribbon and a printing medium.

Since the thermal head 100 uses the ceramic substrate 101 having high thermal conductivity, thermal energy generated from the heating area 103*a* is released from the glass layer 102 through the ceramic substrate 101. Thus, the temperature immediately drops with excellent responsiveness. However, because the temperature of the thermal head 100 easily lowers due to the structure in which the thermal energy from the heating area 103*a* is released toward the ceramic substrate 101, the power consumption necessary for raising the temperature to the sublimation temperature increases and thus thermal efficiency decreases. According to the thermal head 100 which has high responsiveness but low thermal efficiency, it is necessary to heat the heating area 103*a* for a long time so as to obtain a desired concentration. As a result, the power consumption rises, and therefore increase in printing speed with power saving is difficult to achieve.

In order to overcome these drawbacks, the present inventors developed a thermal head 110 shown in FIG. 21. This thermal head 110 is now explained as art related to the invention. The thermal head 110 uses not a ceramic substrate but a glass layer 111 having lower thermal conductivity than that of the ceramic substrate so as to prevent transmission of thermal energy toward the substrate at the time of thermal transfer of color material onto a printing medium. According to the structure of the thermal head 110, a heating resistor 112, a pair of electrodes 113*a* and 113*b*, and a protection layer 114 are formed in this order on the glass layer 111 which has a substantially circular-arc-shaped projecting portion 111*a*. The projecting portion 111*a* of the glass layer 111 is exposed between the pair of the electrodes 113*a* and 113*b*, and has a substantially circular-arc shape so that a heating area 112*a* of the heating resistor 112 can be opposed to the ink ribbon and the printing medium.

Since the glass layer 111 having lower thermal conductivity than that of the ceramic substrate 101 shown in FIG. 20 functions as the ceramic substrate 101 in the thermal head 110, thermal energy generated from the heating area 112*a* is not easily released toward the glass layer 111. As a result, the quantity of heat supplied to the ink ribbon increases in the thermal head 110, and the temperature immediately rises at the time of thermal transfer of the color material onto the printing medium. Thus, the power consumption necessary for raising the temperature to the sublimation temperature of the color material decreases, which leads to improvement of thermal efficiency. However, since the thermal energy accumulated on the glass layer 111 is not easily released in the thermal head 110, the temperature does not immediately drop due to the presence of the thermal energy accumulated on the glass layer 111. Thus, the responsiveness lowers in contrast to the thermal head 100, and the printing speed of the thermal head 110 having low responsiveness is difficult to increase though its thermal efficiency is improved.

For achieving high-speed printing of high-quality images and characters with reduced power consumption, it is desirable that a thermal transfer type printer has both high thermal efficiency which is insufficient in the case of the thermal head 100 and high responsiveness which is insufficient in the case of the thermal head 110. Thus, the present inventors further developed a thermal head 120 shown in FIG. 22. This thermal head 120 is now discussed as other art related to the invention. Similarly to the thermal head 110 described above, the thermal head 120 includes a glass layer 121 having a substantially circular-arc-shaped projecting portion 121*a*, and a heating resistor 122, a pair of electrodes 123*a* and 123*b*, and a protection layer 124 are formed on the glass layer 121 in this order. The projecting portion 121*a* is formed such that a heating area 122*a* of the heating resistor 122 exposed between the pair of the electrodes 123*a* and 123*b* can be opposed to an ink ribbon and a printing medium. A groove 125 filled with air is formed inside the glass layer 121.

According to the thermal head 120 having the groove 125 on the glass layer 121, thermal conductivity of the groove 125 decreases due to the characteristic of the air having lower thermal conductivity than that of glass. As a result, heat release toward the glass layer 121 is further reduced compared with the thermal head 100 using the ceramic substrate 101 shown in FIG. 20. In this case, the quantity of heat supplied to the ink ribbon increases in the thermal head 120, and therefore the power consumption necessary for raising the temperature to the sublimation temperature of color material decreases and thermal efficiency increases. Moreover, since the thickness of the glass layer 121 is reduced by providing the groove 125 on the glass layer 121 in the thermal head 120, the quantity of accumulated heat on the glass layer 121 decreases and thus the thermal energy accumulated in the glass layer 121 can be released in a shorter time than in the case of the thermal head 110 having no groove on the glass layer 111 shown in FIG. 21. As a result, the temperature rapidly drops when the color material is not thermally transferred, which contributes to higher responsiveness. Accordingly, the thermal head 120 improves both thermal efficiency and responsiveness by providing the groove 125 on the glass layer 121. That is, the thermal head 120 can solve both the drawback of the thermal head 100 and the drawback of the thermal head 110.

As illustrated in FIG. 23, the thermal head 120 is affixed to a heat release member 126 for releasing thermal energy generated from the heating area 122*a* by adhesive in most cases. In addition, a semiconductor chip 127 having a driving circuit for driving the heating resistor 122 is provided on the same surface of the glass layer 121 as the surface where the heating resistor 122, the pair of the electrodes 123*a* and 123*b*, and the protection layer 124 are provided, and the semiconductor chip 127 is electrically connected with the electrode 123*b* by a wire 128 in most cases.

There is a demand for a miniaturization of a printer using the thermal head 120, particularly in the case of a household printer. In order to reduce the size of the printer, miniaturization of the thermal head 120 is necessary.

However, since the semiconductor chip 127 is disposed on the same surface of the glass layer 121 as the surface where the heating resistor 122 and other components are located in the thermal head 120, the size of the glass layer 121 is inevitably large. Therefore, miniaturization of the thermal head 120 and thus size reduction of the printer are difficult. Additionally, the cost increases since the large-sized glass layer 121 is used in the thermal head 120.

As illustrated in FIG. 23, the thermal head 120 is affixed to the heat release member 126 for releasing thermal energy from the heating area 122*a* by adhesive, and the semiconductor chip 127 having the driving circuit for driving the heating area 122*a* is provided on the same surface of the glass layer 121 as the surface where the heating resistor 122, the pair of the electrodes 123*a* and 123*b*, and the protection layer 124. The semiconductor chip 127 is electrically connected with the electrode 123*b* facing to the semiconductor chip 127 by the wire 128. The semiconductor chip 127 is higher than a portion where the heating area 122*a* is provided in the thermal head 120. Thus, in the printer using the thermal head 120, it is necessary to dispose the positions of moving paths of an ink ribbon and a printing medium away from the thermal head 120 so that the ink ribbon and the printing medium do not contact the semiconductor chip 127. This requirement imposes limitation on the locations of the moving paths of the ink ribbon and the printing medium.

There is a demand for miniaturization of a printer using the thermal head 120, particularly in the case of a household printer. In order to miniaturize the printer, size reduction of the thermal head 120 is necessary.

In the case of the thermal head 120, the ink ribbon and the printing medium moving between the thermal head 120 and the platen are positioned substantially perpendicular to the thermal head 120 so that color material can be appropriately transferred onto the printing medium by heat during movement of the ink ribbon and the printing medium between the thermal head 120 and the platen. When the movement of the ink ribbon and the printing medium is substantially perpendicular to the thermal head 120 in the printer, there is a possibility of contact between the semiconductor chip 127 and the ink ribbon and the printing medium since the semiconductor chip 127 is higher than the portion having the heating area 122*a*. In the structure of the thermal head 120, therefore, it is necessary to dispose the semiconductor chip 127 away from the portion of the heating area 122*a* so that the contact between the semiconductor chip 127 and the ink ribbon and the printing medium can be avoided. This requirement increases the size of the glass layer 121 of the thermal head 120, and therefore the cost rises and miniaturization becomes difficult.

In order to overcome these drawbacks, the present inventors further developed a thermal head 130 shown in FIG. 24. The thermal head 130 is now discussed as further art related to the invention. Similarly to the thermal head 120 described above, the thermal head 130 includes a glass layer 131 having a substantially circular-arc-shaped projecting portion 131*a*, and a heating resistor 132, a pair of electrodes 133*a* and 133*b*, and a protection layer 134 are formed on the glass layer 131 in this order. The projecting portion 131*a* is formed such that a heating area 132*a* of the heating resistor 132 exposed between the pair of the electrodes 133*a* and 133*b* can be opposed to an ink ribbon and a printing medium. A groove 135 filled with air is formed inside the glass layer 131. The thermal head 130 is affixed to a heat release member 136 by adhesive. According to the thermal head 130, a semiconductor chip 136 is not provided on the glass layer 131 but on another component as a rigid substrate 137. In the thermal head 130, the electrode 133*b* facing to the semiconductor chip 136 is electrically connected with a connection terminal 138 of the semiconductor chip 136 provided on the rigid substrate 137 by a wire 139, and the wire bonding portion is sealed by resin 140. According to the thermal head 130, the size of the glass layer 131 is reduced compared with the case of the thermal head 120, and therefore the cost is lowered.

According to the structure of the thermal head 130, the height of the semiconductor chip 136 is smaller than the height of the portion having the heating area 132*a*. However, there is a possibility that the wire bonding portion between the electrode 133*b* on the glass layer 131 and the connection terminal 138 on the rigid substrate 137 is positioned higher than the portion of the heating area 132*a*. Thus, even in the thermal head 130, the positions of the moving paths of the ink ribbon and the printing medium are limited with a necessity for disposing the wire bonding portion away from the portion of the heating area 132*a*. This requirement makes miniaturization difficult. Accordingly, even in the case of the printer using the thermal head 130, the positions of the moving paths of the ink ribbon and the printing medium moving in the vicinity of the thermal head 130 are limited.

JP-A-8-216443 is an example of related art.

SUMMARY OF THE INVENTION

Accordingly, there is a need for a compact thermal head, and a compact printer including the thermal head.

In addition, there is a need for a compact thermal head and a compact printer including the thermal head, in which an ink ribbon and a printing medium move along paths disposed at arbitrary positions.

According to an embodiment of the invention, there is provided a thermal head which includes a head containing a glass layer. The glass layer has a projecting portion on one surface and a concave groove on the other surface at a position opposed to the projecting portion. The head further contains a heating resistor disposed on the projecting portion, and a pair of electrodes disposed on both sides of the heating resistor. The thermal head further includes a rigid substrate on which a control circuit for the head is provided, and a flexible substrate for electrically connecting the head and the rigid substrate.

According to another embodiment of the invention, there is provided a printer which includes a thermal head. The thermal head contains a head containing a glass layer. The glass layer has a projecting portion on one surface and a concave groove on the other surface at a position opposed to the projecting portion. The head further contains a heating resistor disposed on the projecting portion, and a pair of electrodes disposed on both sides of the heating resistor. The thermal head further contains a rigid substrate on which a control circuit for the head is provided, and a flexible substrate for electrically connecting the head and the rigid substrate.

According to the thermal head and the printer in these embodiments of the invention, the head and the rigid substrate on which the control circuit is provided are connected by the flexible substrate. Thus, the position of the rigid substrate can be disposed at an arbitrary position. According to the embodiments of the invention, the rigid substrate is disposed along the side of the heat release member by miniaturizing the head and the heat release member, for example, by bending the flexible substrate, so as to make the entire structure compact.

According to a further embodiment of the invention, there is provided a thermal head disposed at a position opposed to a platen such that an ink ribbon and a printing medium can move between the platen and the thermal head for thermally transferring color material of the ink ribbon onto the printing medium by applying thermal energy to the ink ribbon. The thermal head includes a head containing a glass layer. The glass layer has a projecting portion on one surface and a concave groove on the other surface at a position opposed to the projecting portion. The head further contains a heating resistor disposed on the projecting portion, and a pair of electrodes disposed on both sides of the heating resistor. The thermal head includes a heat release member on which the head is provided, a rigid substrate on which a control circuit for the head is provided, and a flexible substrate for electrically connecting the head and the rigid substrate. A semiconductor chip having a driving circuit for driving the heating resistor is mounted on one of the surfaces of the flexible substrate. The flexible substrate is bent so that the rigid substrate can be disposed along the side of the heat release member.

According to a still further embodiment of the invention, there is provided a printer which includes a thermal head disposed at a position opposed to a platen such that an ink ribbon and a printing medium can move between the platen and the thermal head for thermally transferring color material of the ink ribbon onto the printing medium by applying thermal energy to the ink ribbon. The thermal head includes a head containing a glass layer. The glass layer has a projecting portion on one surface and a concave groove on the other surface at a position opposed to the projecting portion. The head further contains a heating resistor disposed on the projecting portion, and a pair of electrodes disposed on both sides of the heating resistor. The thermal head further includes a heat release member on which the head is provided, a rigid substrate on which a control circuit for the head is provided, and a flexible substrate for electrically connecting the head and the rigid substrate. A semiconductor chip having a driving circuit for driving the heating resistor is mounted on one of the surfaces of the flexible substrate. The flexible substrate is bent so that the rigid substrate can be disposed along the side of the heat release member.

According to the thermal head and the printer in these embodiments of the invention, the head and the rigid substrate on which the control circuit is provided are connected by the flexible substrate. The rigid substrate is disposed along the side of the heat release member by bending the flexible substrate. Accordingly, the structure can be compact, and the ink ribbon and the printing medium can move along paths disposed at arbitrary positions.

BRIEF DESCRIPTION OF THE DRAWINGS

FIG. 5A is a cross-sectional view showing the entire structure of the head, and FIG. 5B is an enlarged partial cross-sectional view showing a distal end area of a groove.

FIG. 8A is a cross-sectional view showing the entire structure of the head, and FIG. 8B is an enlarged partial cross-sectional view showing a projecting portion.

DETAILED DESCRIPTION OF THE PREFERRED EMBODIMENT

A thermal transfer type printer using a thermal head according to an embodiment of the invention is hereinafter described in detail with reference to the drawings.

Figure 1:
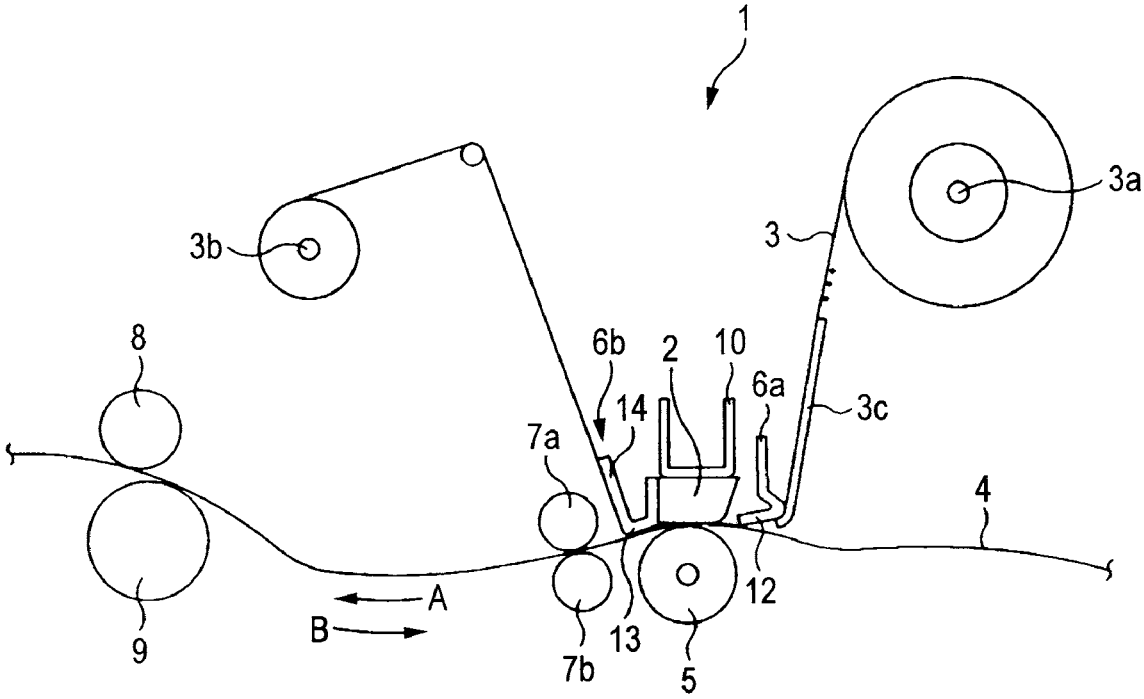
FIG. 1 schematically illustrates a printer including a thermal head according to an embodiment of the invention.

A thermal transfer type printer 1 (hereinafter referred to as printer 1) shown in FIG. 1 is a sublimation type printer which sublimates color material of an ink ribbon and transfers the sublimated color material onto a printing medium. The printer 1 uses a thermal head 2 according to the embodiment of the invention as a recording head. The printer 1 sublimates color material of an ink ribbon 3 and thermally transfers the color material onto a printing medium 4 by applying thermal energy generated from the thermal head 2 to the ink ribbon 3, thereby printing color images and characters on the printing medium 4. The printer 1 is a household printer, and can print on the printing medium such as post cards.

The ink ribbon 3 used herein is made of long resin film. The ink ribbon 3 before thermal transfer is wound around a supply spool 3*a*, and the ink ribbon 3 after thermal transfer is wound around a winding spool 3*b* and accommodated in an ink cartridge. A transfer layer 3*c* which includes an ink layer having yellow color material, an ink layer having magenta color material, an ink layer having cyan color material, and a laminate layer having a laminate film to be thermally transferred on the printing medium 4 so as to increase retainability of images and characters printed on the printing medium 4 is repeatedly formed on one surface of the long resin film of the ink ribbon 3.

Figure 2:
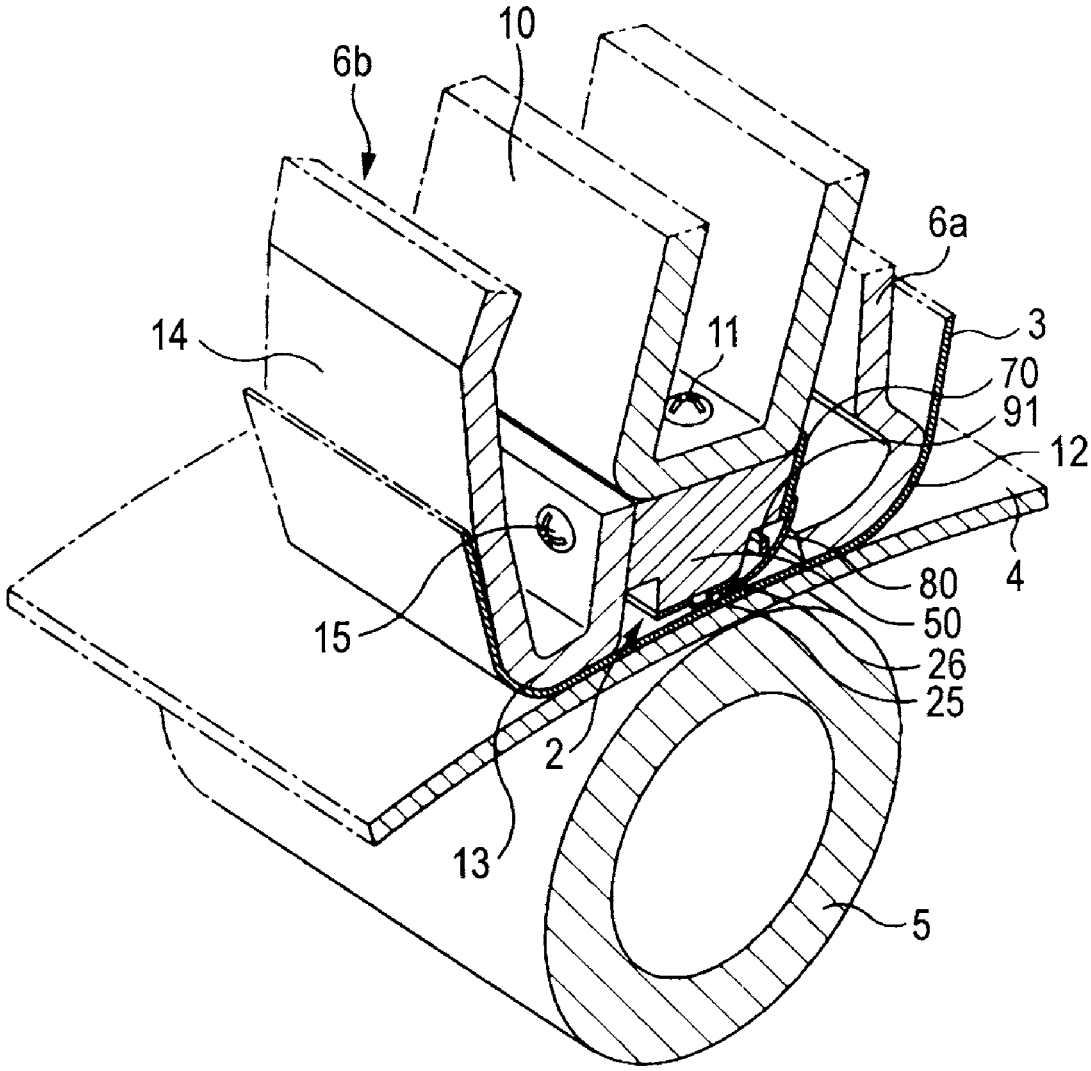
FIG. 2 is a partial perspective view showing the positional relation between the thermal head and ribbon guides.

As illustrated in FIG. 1, the printer 1 includes the thermal head 2, a platen 5 disposed at a position opposed to the thermal head 2, a plurality of ribbon guides 6*a* and 6*b* for determining the movement direction of the attached ink ribbon 3, a pinch roller 7*a* and a capstan roller 7*b* for guiding the printing medium 4 such that the printing medium 4 can move between the thermal head 2 and the platen 5 with the ink ribbon 3, a discharge roller 8 for discharging the printing medium 4 after printing, and a conveyance roller 9 for conveying the printing medium 4 toward the thermal head 2. As illustrated in FIG. 2, the thermal head 2 is attached to an attachment member 10 provided on a housing of the printer 1 by a fixing member 11 such as a screw, and in this manner the thermal head 2 is fixed to the printer 1.

The ribbon guides 6*a* and 6*b* for guiding the ink ribbon 3 are disposed before and behind the thermal head 2, i.e., the entrance side and the discharge side of the ink ribbon 3 with respect to the thermal head 2. The ribbon guides 6*a* and 6*b* positioned before and behind the thermal head 2 guide the ink ribbon 3 and the printing medium 4 into the space between the thermal head 2 and the platen 5 such that the overlapped ink ribbon 3 and the printing medium 4 can contact the thermal head 2 substantially at right angles. Thus, thermal energy generated from the thermal head 2 can be securely applied to the ink ribbon 3.

The ribbon guide 6*a* is disposed on the entrance side of the ink ribbon 3 with respect to the thermal head 2. The ribbon guide 6*a* has a curved lower end surface 12 so that the ink ribbon 3 supplied from the supply spool 3*a* positioned above the thermal head 2 can enter between the thermal head 2 and the platen 5.

The ribbon guide 6*b* is disposed on the discharge side of the ink ribbon 3 with respect to the thermal head 2. The ribbon guide 6*b* has a flat portion 13 having a flat lower end, and a separating portion 14 projecting upward substantially in the vertical direction from the end of the flat portion 13 opposite to the thermal head 2 to separate the ink ribbon 3 from the printing medium 4. The ribbon guide 6*b* cools the heat of the ink ribbon 3 after thermal transfer by the flat portion 13. After cooled on the flat portion 13, the ink ribbon 3 rises in the direction substantially perpendicular to the printing medium 4 along the separating portion 14 to be separated from the printing medium 4. The ribbon guide 6*b* is attached to the thermal head 2 by a fixing member 15 such as a screw.

According to the printer 1 having this structure, the ink ribbon 3 moves between the thermal head 2 and the platen 5 in the winding direction in accordance with rotation of the winding spool 3*b* in the winding direction with the platen 5 pressed against the thermal head 2 as illustrated in FIG. 1. The printing medium 4 sandwiched between the pinch roller 7*a* and the capstan roller 7*b* moves in the discharge direction (direction indicated by arrow A in FIG. 1) in accordance with the rotation of the capstan roller 7*b* and the discharge roller 8 in the discharge direction. In printing, thermal energy is initially applied from the thermal head 2 to the yellow ink layer of the ink ribbon 3 to thermally transfer the yellow color material onto the printing medium 4 overlapping with the ink ribbon 3 during movement. After thermal transfer of the yellow color material, the conveyance roller 9 is rotated toward the thermal head 2 (direction indicated by arrow B in FIG. 1) so that the magenta color material can be thermally transferred to the image forming area for forming images and characters to which area the yellow color material has been thermally transferred. As a result, the printing medium 4 moves in the reverse direction toward the thermal head 2 to reach a position where the starting end of the image forming area comes opposed to the thermal head 2, thereby the magenta ink layer of the ink ribbon 3 comes opposed to the thermal head 2. Then, thermal energy is applied to the magenta ink layer in the same manner as in the thermal transfer of the yellow ink layer so that the magenta color material can be thermally transferred to the image forming area of the printing medium 4. The cyan color material and the laminate film are thermally transferred in the similar manner to the method of the thermal transfer of the magenta color material. After sequential thermal transfer of the cyan color material and the laminate film onto the printing medium 4, printing of color images and characters is completed.

The thermal head 2 used in the printer 1 can print images having edges as margins at both ends in the direction perpendicular to the moving direction of the printing medium 4, that is, in the width direction of the printing medium 4. In addition, the printer 1 can print images having no edge as margin. The thermal head 2 has a width larger than the width of the printing medium 4 in a direction indicated by an arrow L in FIG. 3 so that color material can be thermally transferred onto the printing medium 4 including both ends of the medium 4 in the width direction.

Figure 3:
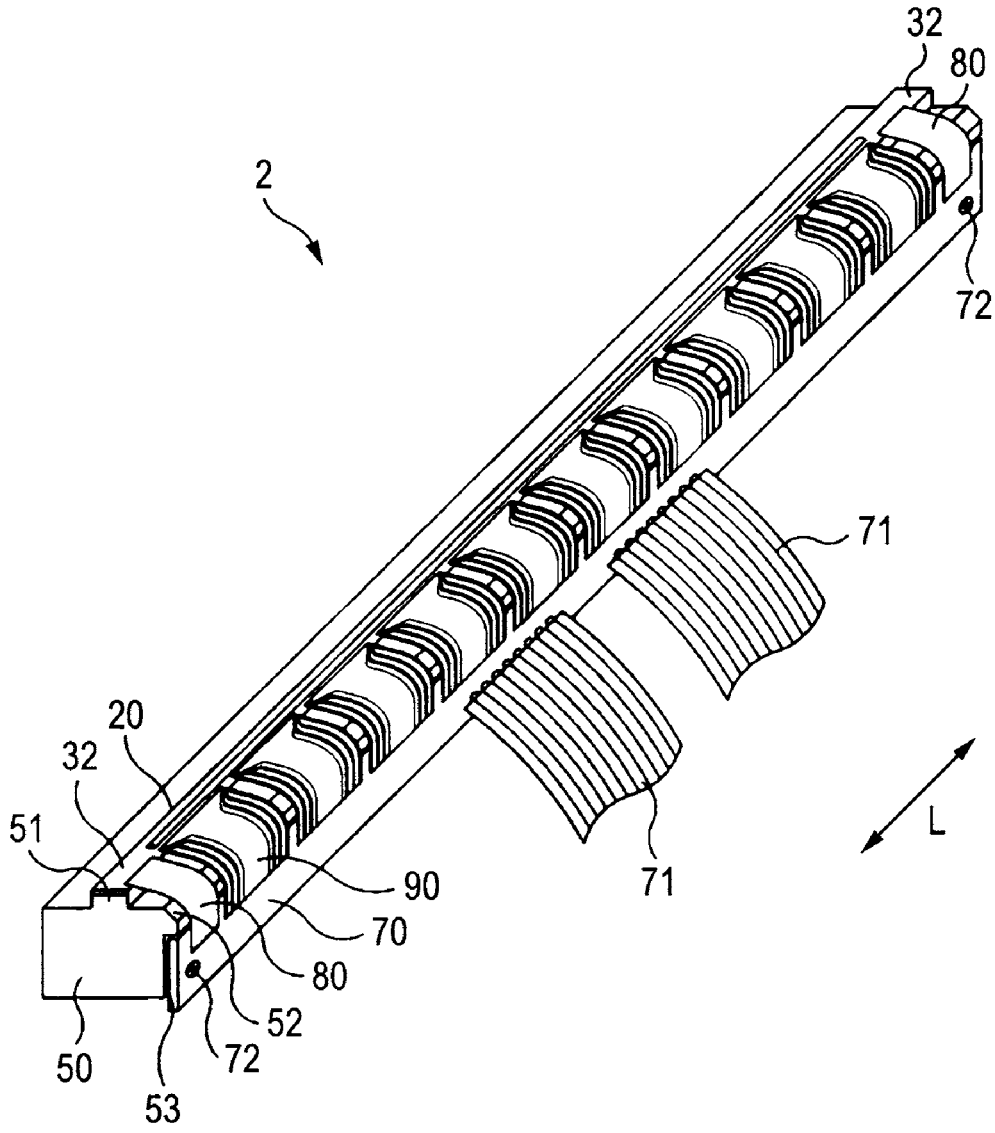
FIG. 3 is a perspective view of the thermal head.

According to the structure of the thermal head 2, a head 20 for carrying out thermal transfer of the color material of the ink ribbon 3 to the printing medium 4 is attached to a heat release member 50 as illustrated in FIG. 3. As can be seen from FIGS. 4 and 5A, the head 20 has a glass layer 21, and a heating resistor 22, a pair of electrodes 23*a* and 23*b* provided on both sides of the heating resistor 22, and a resistor protecting layer 24 provided on and around the heating resistor 22 are formed on the glass layer 21. The thermal head 2 has heating areas 22*a* as portions of the heating resistor 22 exposed between the pair of the electrodes 23*a* and 23*b*. The pair of the electrode 23*a*, the heating resistor 22, and the resistor protecting layer 24 are formed on the upper surface of the glass layer 21 as a base layer of the head 20.

Figure 4:
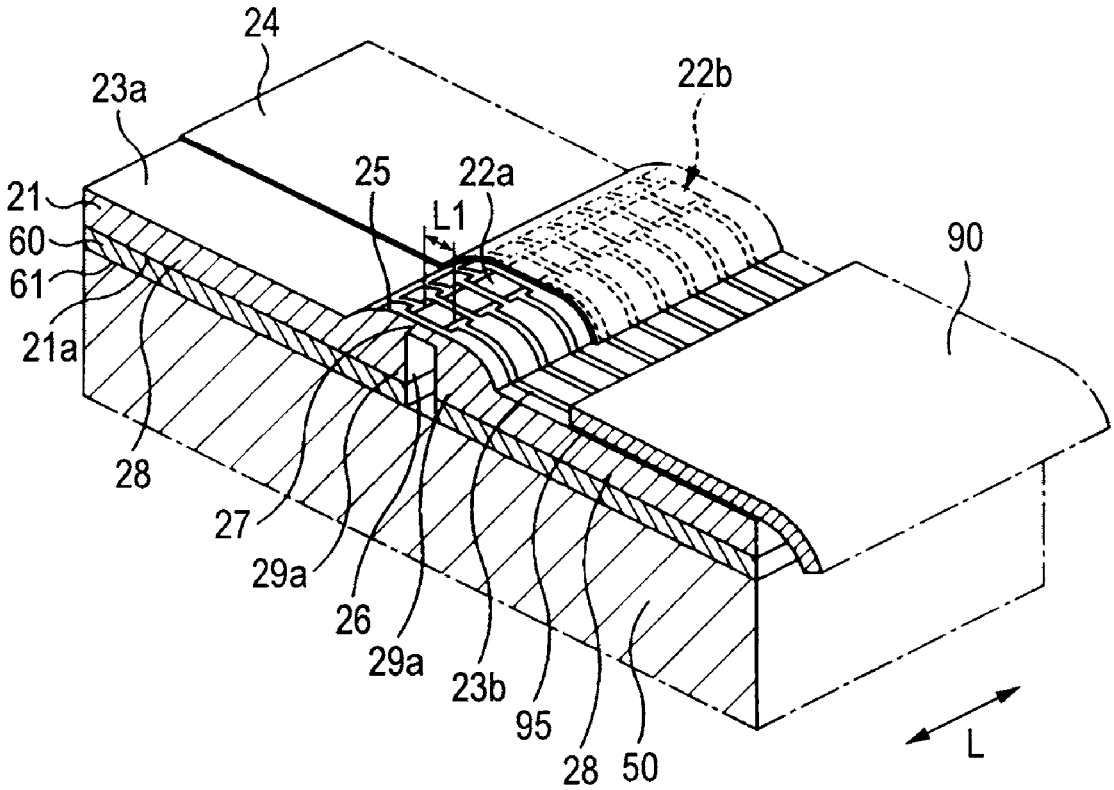
FIG. 4 is a partial perspective view of the thermal head.
Figure 5A:
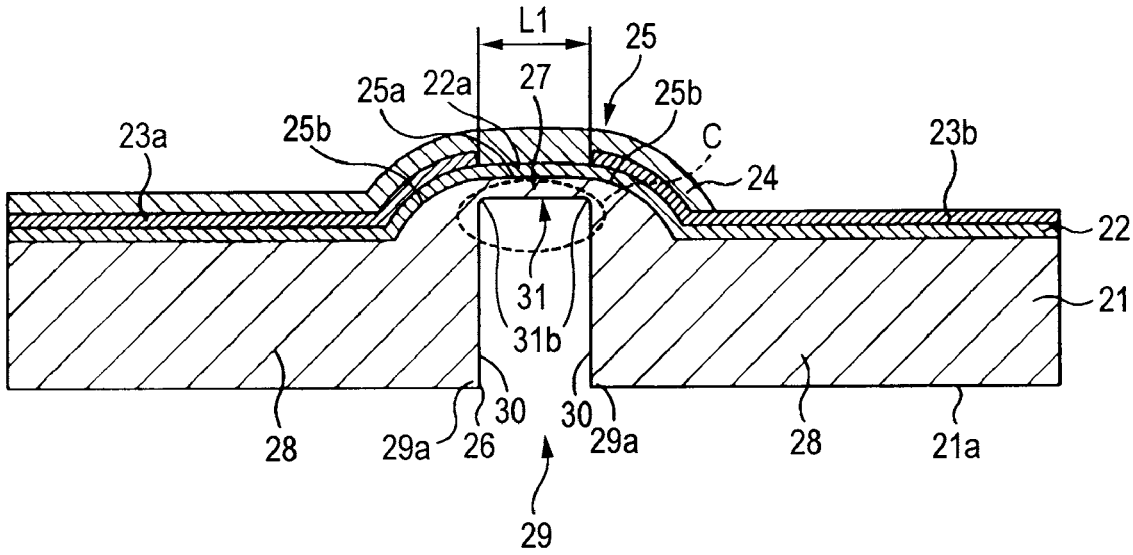
FIGS. 5A and 5B are cross-sectional views of a head, where

As illustrated in FIGS. 4 and 5A, the glass layer 21 has a substantially circular-arc-shaped projecting portion 25 on the outer surface facing the ink ribbon 3, and a groove 26 on the inner surface. The glass layer 21 is substantially rectangular and made of glass having a softening point of about 500 degrees Celsius, for example. The projecting portion 25 is positioned substantially at the center of the glass layer 21 in the width direction, and is substantially semi-cylindrical in the length direction (L direction in FIG. 4). Since the substantially circular-arc-shaped projecting portion 25 is provided on the surface of the glass layer 21 opposed to the ink ribbon 3, the heating areas 22*a* disposed on the projecting portion 25 can smoothly contact the ink ribbon 3. Thus, the thermal energy generated from the heating areas 22*a* of the heating resistor 22 can be appropriately applied to the ink ribbon 3.

A central area 25*a* of the projecting portion 25 may be substantially flat. The glass layer 21 may be made of any material as long as it has predetermined surface properties and thermal characteristics, for which material glass is typically used. Examples of glass herein include synthetic jewelry and artificial stone such as artificial crystal, artificial ruby, and artificial sapphire, high-density ceramic, and others.

As illustrated in FIGS. 4 and 5A, the groove 26 formed on the inner surface of the glass layer 21 is opposed to a row 22*b* of the heating areas 22*a* formed substantially in a linear direction along the length of the thermal head 2 (L direction in FIG. 4) on the projecting portion 25, and concaved toward the heating areas 22*a*. In the glass layer 21, a space between the projecting portion 25 and the groove 26 is a heat accumulating portion 27 for accumulating thermal energy generated from the heating areas 22*a*.

Since the glass layer 21 has the groove 26, the thermal energy does not conduct throughout the layer because of the characteristic of the air that the air has lower thermal conductivity than that of glass. Thus, thermal energy is easily accumulated on the heat accumulating portion 27 formed between the heating areas 22*a* and the groove 26. Since thermal energy is not released throughout the layer by the presence of the groove 26 in the structure of the glass layer 21, heat release of thermal energy generated from the heating areas 22*a* can be reduced and therefore the quantity of heat supplied to the ink ribbon 3 can be increased. As a result, thermal efficiency of the thermal head 2 can be improved by the adoption of the glass layer 21. Moreover, at the time of thermal transfer of the color material onto the printing medium 4, the temperature of the color material can be immediately increased to the sublimation temperature with reduced power by utilizing the thermal energy accumulated on the heat accumulating portion 27 according to the structure of the glass layer 21. Thus, thermal efficiency of the thermal head 2 can be enhanced. Furthermore, according to the glass layer 21 having the grove 26, the thickness of the heat accumulating portion 27 is reduced and therefore the quantity of accumulated heat is decreased. As a result, heat can be released in a short time, and the temperature of the thermal head 2 can be immediately lowered when the heating areas 22*a* do not generate heat. According to the glass layer 21 having the groove 26, therefore, thermal efficiency and responsiveness of the thermal head 2 can be improved. Thus, the thermal head 2 having excellent responsiveness can print high-quality images and characters at high speed with reduced power without causing problems such as blur of images and characters.

As illustrated in FIG. 5A, the heating resistor 22 for generating thermal energy is formed on the surface of the glass layer 21 on which the projecting portion 25 is provided. The heating resistor 22 is made of material which is highly resistant and has thermal resistance such as Ta—N and Ta—$SiO_2$. The heating areas 22*a* of the heating resistor 22, which are exposed between the pair of the electrodes 23*a* and 23*b* to generate heat, are provided on the projecting portion 25 substantially in a linear direction. Each of the heating areas 22*a* is slightly larger than the dot size of thermal transfer so that thermal energy can be dispersed, and has a substantially rectangular or square shape. The heating resistor 22 is provided on the glass layer 21 by pattern formation using photolithography technology.

Figure 6:
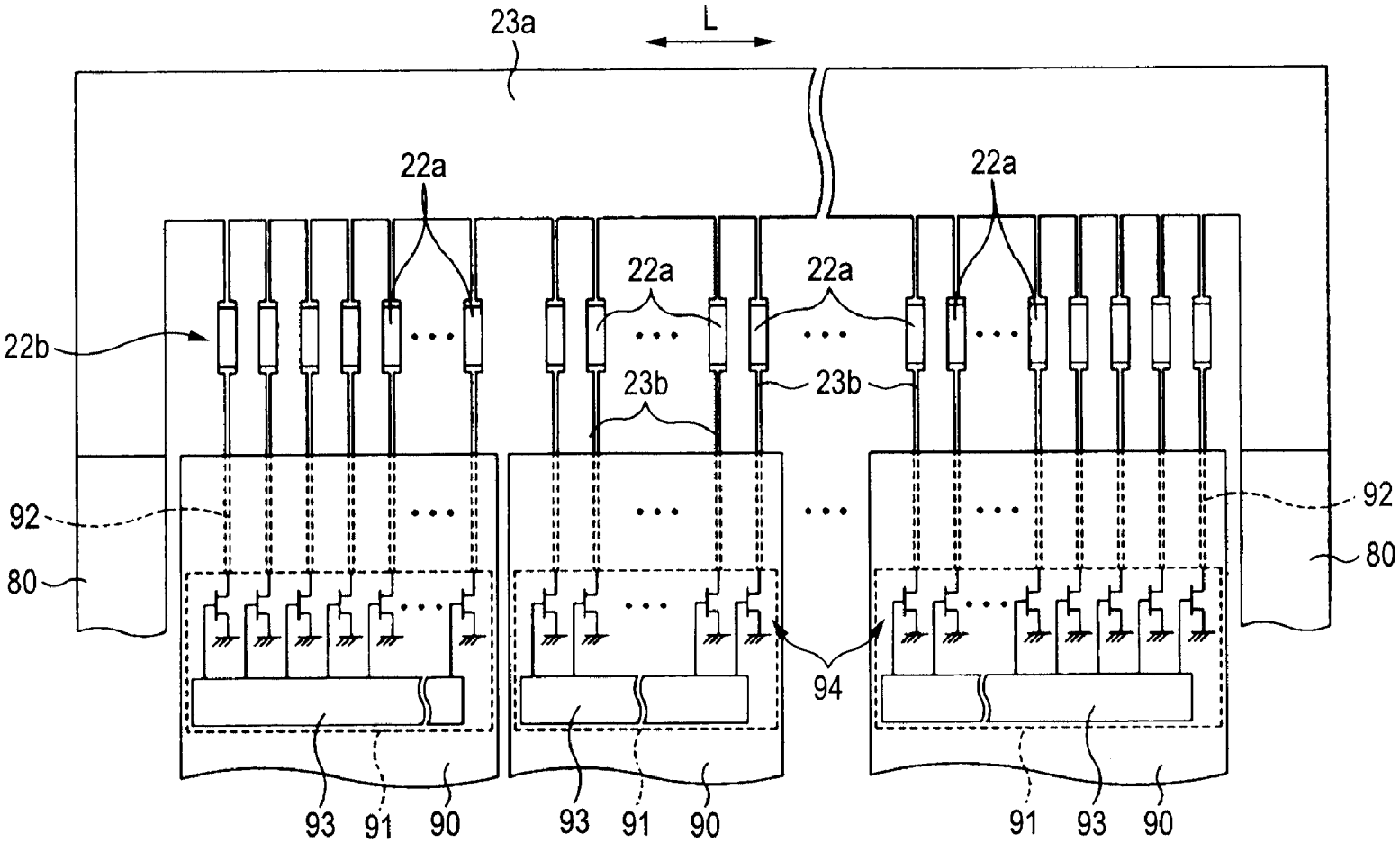
FIG. 6 is a plan view of the head.

The pair of the electrodes 23*a* and 23*b* disposed on both sides of the heating resistor 22 supplies current from a power source not shown in detail to the heating areas 22*a* such that the heating areas 22*a* can generate heat. The pair of the electrodes 23*a* and 23*b* are made of material having high electricity conductivity such as aluminum, gold and copper. As illustrated in FIGS. 4 and 6, the pair of the electrodes 23*a* and 23*b* are constituted of a common electrode 23*a* electrically connected with all the heating areas 22*a* and discrete electrodes 23*b* each of which is electrically and individually connected with the corresponding heating area 22*a*, respectively. The common electrode 23*a* and the discrete electrodes 23*b* are separated from each other with the heating areas 22*a* interposed therebetween.

The common electrode 23*a* is disposed on the glass layer 21 on the side opposite to the side to which a power supply flexible substrate 80 to be described later is affixed with the projecting portion 25 of the glass layer 21 interposed between the common electrode 23*a* and the power supply flexible substrate 80. The common electrode 23*a* is electrically connected with all the heating areas 22*a*. Both ends of the common electrode 23*a* are expanded toward the side to which the power supply flexible substrate 80 is affixed along the shorter side of the glass layer 21 to be electrically connected with the power supply flexible substrate 80. The common electrode 23*a* is electrically connected via the power supply flexible substrate 80 with a rigid substrate 70 which is electrically connected with a not-shown power source such that the power source and the respective heating areas 22*a* can be electrically connected.

The discrete electrodes 23*b* are disposed on the glass layer 21 on the side to which signal flexible substrates 90 to be described later are affixed with the projecting portion 25 of the glass layer 21 interposed between the discrete electrodes 23*b* and the signal flexible substrates 90. Each of the discrete electrodes 23*b* is provided for the corresponding heating area 22*a* with one-to-one correspondence. The discrete electrodes 23*b* are electrically connected with the signal flexible substrates 90 connected with a control circuit for controlling the operation of the heating areas 22*a* on the rigid substrate 70.

The common electrode 23*a* and the discrete electrodes 23*b* supply current to the heating areas 22*a* selected by the circuit for controlling the operation of the heating areas 22*a* for a predetermined period of time to cause the heating areas 22*a* to generate heat until the temperature of the color material rises to the sublimation temperature sufficient for thermal transfer.

According to the structure of the head 20, it is not necessary to provide the heating resistor 22 on the entire surface of the glass layer 21. It is possible to provide the heating resistor 22 on a part of the projecting portion 25 and dispose the ends of the common electrode 23*a* and the discrete electrodes 23*b* on the heating resistor 22.

As illustrated in FIG. 4, the resistor protecting layer 24 disposed at the outermost position of the head 20 covers the entire surfaces of the heating resistor 22 and the common electrode 23*a* and the ends of the discrete electrodes 23*b* on the heating area 22*a* side to protect the heating areas 22*a* and the pair of the electrodes 23*a* and 23*b* provided around the heating areas 22*a* from friction caused by the contact between the thermal head 2 and the ink ribbon 3 or others. The resistor protecting layer 24 is made of inorganic material including metal which has excellent mechanical properties such as high strength and abrasion resistance and excellent thermal properties such as heat resistance, thermal shock resistance and thermal conductivity under a high-temperature environment. An example of the material for the resistor protecting layer 24 is SIALON (product name) containing silicon (Si), aluminum (Al), oxygen (O), and nitrogen (N).

Figure 5B:
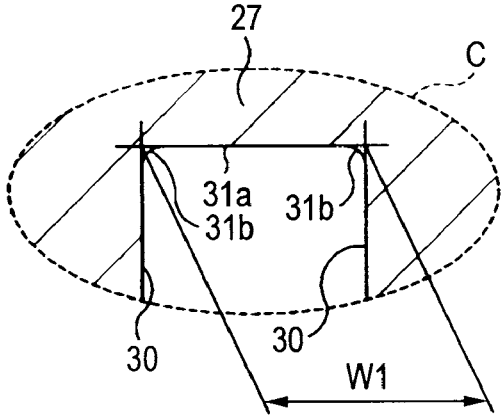

According to the head 20 having the above structure, the groove 26 is formed such that a width W1 of the groove 26 formed at the position opposed to the row 22*b* of the heating areas 22*a* provided on the inner surface of the glass layer 21 substantially in a linear direction along the length of the head 20 (L direction in FIG. 4), that is, a width between the cross points of extension lines of wall surfaces 30 of the groove 26 and an extension line of a ceiling surface 31*a* of the groove 26, becomes equivalent to or larger than a length L1 of the heating areas 22*a* as illustrated in FIGS. 4, 5A and 5B. By setting the width W1 of the groove 26 of the glass layer 21 to a length equivalent to or larger than the length L1 of the heating areas 22*a*, thermal efficiency of the thermal head 2 can be further improved.

More specifically, when the width W1 of the groove 26 of the glass layer 21 is established as a length equivalent to or larger than the length L1 of the heating areas 22*a*, the thickness at both ends of the heat accumulating portion 27 becomes smaller than that in the case where the width W1 of the groove 26 is smaller than the length L1 of the heating areas 22*a*. Thus, thermal energy accumulated on the heat accumulating portion 27 is not easily released from both ends of the heat accumulating portion 27 toward an area therearound, that is, a surrounding area 28 around the groove 26. Heat release is reduced particularly when the width W1 of the groove 26 of the glass layer 21 is larger than the length of the heating areas 22*a* compared with the case where the width W1 is equal to the length of the heating areas 22*a* since the thickness at both ends of the heat accumulating portion 27 in the former case is smaller than that in the latter case. In the structure of the glass layer 21, therefore, heat release toward the surrounding area 28 is reduced. As a result, the quantity of heat supplied to the ink ribbon 3 is further increased, and thermal efficiency of the thermal head 2 can be further improved.

The length of the heating areas 22*a* is 200 μm, for example. The allowable width of the groove 26 is in the range from 50 μm to 700 μm, and preferably in the range from 200 μm to 400 μm.

Figure 10:
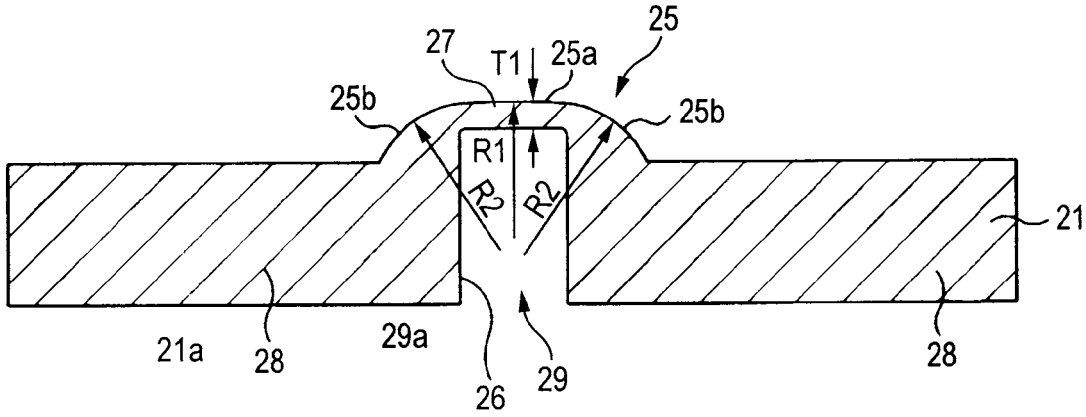
FIG. 10 is a cross-sectional view of the glass layer where a radius of curvature on both sides of the projecting portion is smaller than a radius of curvature at the central area of the projecting portion.

As illustrated in FIGS. 5A and 10, a radius of curvature R2 at both sides 25*b* of the projecting portion 25 of the glass layer 21 is smaller than a radius of curvature R1 at the central area 25*a* (R1>R2). For example, the radius of curvature R1 at the central area 25*a* of the glass layer 21 is 2.5 μm, and the radius of curvature R2 at the sides 25*b* is 1.0 μm. When the projecting portion 25 of the glass layer 21 is formed such that the radius of curvature R2 at the sides 25*b* is smaller than the radius of curvature R1 at the central area 25*a*, the thickness of the glass layer 21 at the position between the sides 25*b* and the groove 26 becomes smaller, that is, the thickness at both ends of the heat accumulating portion 27 becomes smaller, than that in the case where the radius of curvature R2 at the sides 25*b* is equal to or larger than the radius of curvature R1 at the central area 25*a* (R1<R2). As a result, the quantity of accumulated heat on the heat accumulating portion 27 is further decreased, and thus the quantity of heat released from both ends to the surrounding area 28 of the groove 26 is further reduced. Consequently, thermal efficiency can be further increased. When the radius of curvature R2 at the sides 25*b* of the projecting portion 25 of the glass layer 21 is smaller than the radius of curvature R1 at the central area 25*a*, the width of the projecting portion 25 of the glass layer 21 is reduced. As a result, the entire layer can be made compact.

As illustrated in FIG. 5A, the wall surfaces 30 extend upward substantially in the vertical direction from the sides of the groove 26 opposite to the heating areas 22*a*, that is, a base end 29 of the groove 26. According to the glass layer 21 having the groove 26 thus formed, pressure applied from the projecting portion 25 to both ends 29*a* at the base end 29 of the groove 26 is not concentrated on the ends 29*a* but dispersed toward a bottom surface 21*a* of the glass layer 21 when the platen 5 presses the thermal head 2. Thus, physical strength against the press by the platen 5 can be increased. Accordingly, deformation and breakage of the ends 29*a* of the glass layer 21 caused by the press from the platen 5 can be prevented, and therefore deformation and breakage of the glass layer 21 can be avoided.

Figure 7:
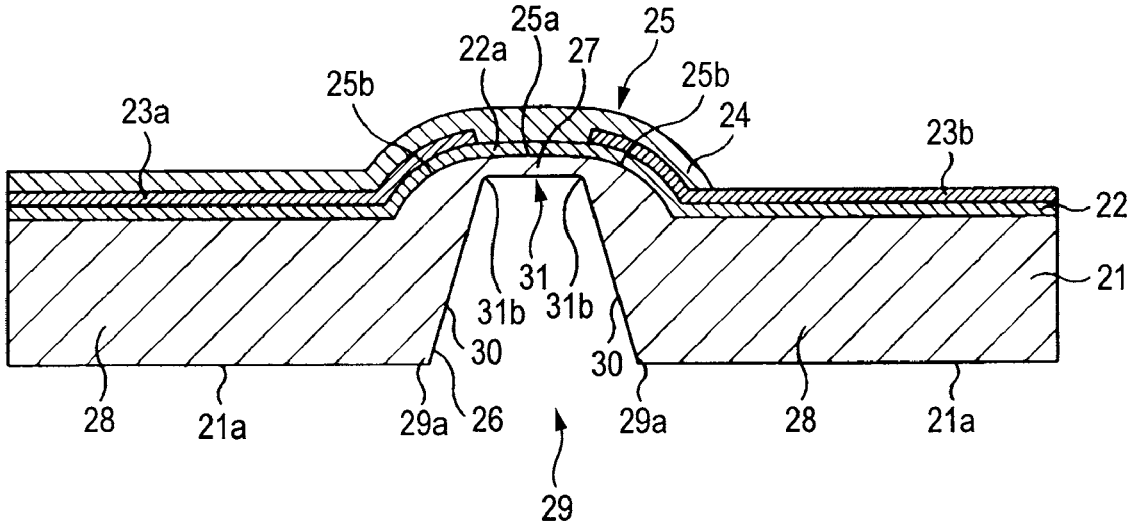
FIG. 7 is a cross-sectional view of a head in another example.

As illustrated in FIG. 7, the width between the wall surfaces 30 of the glass layer 21 opposed to each other in the length direction of the heating areas 22*a* may be determined such that the width at the base end 29 is larger than the width at a distal end 31. In the case of the glass layer 21 having this structure, the groove 26 can be easily separated from a metal mold when the groove 26 is formed by heat pressing using the metal mold for the reason that the width between the wall surfaces 30 of the glass layer 21 opposed to each other in the length direction of the heating areas 22*a* at the base end 29 is larger than the width at the distal end 31. Thus, the glass layer 21 can be easily formed by using a metal mold, and the production efficiency can be increased.

As illustrated in FIGS. 5A and 5B, both corners 31*b* of the ceiling surface 31*a* at the distal end 31 of the groove 26 of the glass layer 21 are substantially circular-arc-shaped, and the ceiling surface 31*a* between the corners 31*b* is substantially flat. Since the corners 31*b* at the distal end 31 of the groove 26 are substantially circular-arc-shaped, pressure applied from the projecting portion 25 to the corners 31*b* when the platen 5 presses the thermal head 2 is dispersed and the physical strength against the press by the platen 5 is increased. Thus, deformation and breakage of the corners 31*b* at the distal end 31 of the groove 26 of the glass layer 21 caused by the press from the platen 5 can be prevented.

Figure 8A:
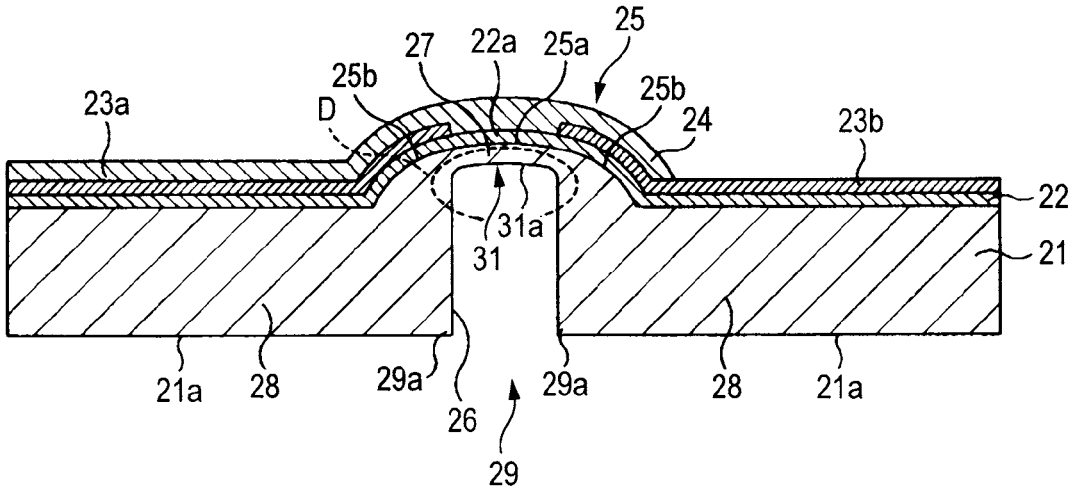
FIGS. 8A and 8B are cross-sectional views of a head in a further example, where
Figure 8B:
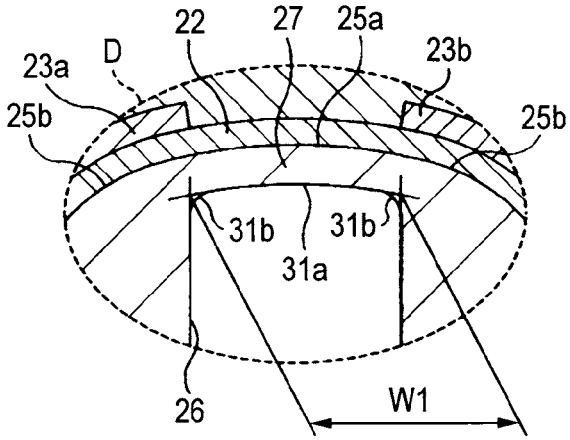
Figure 9:
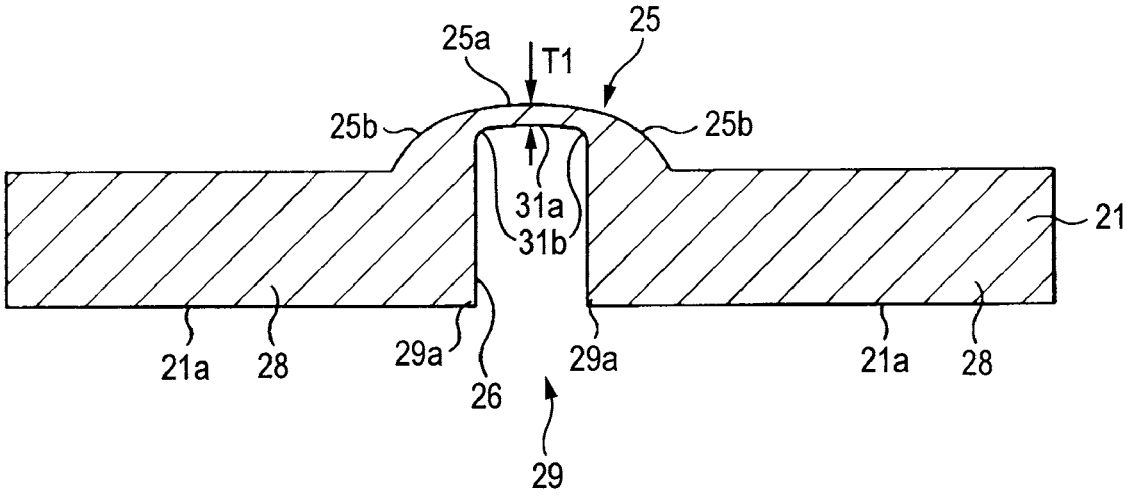
FIG. 9 is a cross-sectional view only showing a glass layer of the head shown in FIGS. 8A and 8B.

As illustrated in FIGS. 8A, 8B and 9, the ceiling surface 31*a* of the groove 26 may be substantially circular-arc-shaped similarly to the surface of the central area 25*a* of the projecting portion 25 such that the thickness of the glass layer 21 of the head 20 shown in FIGS. 5A and 5B in the area between the ceiling surface 31*a* at the distal end 31 of the groove 26 and the surface of the central area 25*a* of the projecting portion 25, that is, a thickness T1 of the projecting portion 25 becomes substantially constant, or substantially uniform. When the ceiling surface 31*a* of the groove 26 of the glass layer 21 is concentric with the central area 25*a* of the projecting portion 25 as illustrated in FIG. 9, the thickness T1 of the projecting portion 25 becomes substantially uniform. The thickness T1 of the projecting portion 25 is in the range from 10 μm to 100 μm, preferably in the range from 20 μm to 40 μm. For example, the thickness T1 of 27.5 μm is particularly preferable. According to this structure of the glass layer 21 having the thickness T1 of the projecting portion 25 which is substantially uniform with no variation, stress applied by the press from the platen 5 is not concentrated on the end corners 31*b* of the groove 26. Thus, physical strength increases even when the thickness T1 of the projecting portion 25 of the glass layer 21 is extremely small. Moreover, since the thickness T1 of the projecting portion 25 is substantially uniform, the thickness of the heat accumulating portion 27 becomes substantially uniform. As the thickness of the heat accumulating portion 27 is not variable, thermal balance of the heat accumulating portion 27 is improved, and thermal efficiency and responsiveness of the thermal head 2 are enhanced accordingly.

According to the thermal head 2 having the head 20 constructed as above, thermal energy generated from the heating areas 22*a* is not easily released to the glass layer 21 by the presence of the groove 26 on the glass layer 21. In addition, the heating areas 22*a* can generate heat with reduced power until the temperature of the color material reaches the sublimation temperature by utilizing the heat accumulated on the heat accumulating portion 27. Thus, thermal efficiency is improved. Moreover, since the thickness of the heat accumulating portion 27 is reduced and the quantity of accumulated heat is decreased by the presence of the groove 26 on the glass layer 21, heat is easily released and the responsiveness is enhanced. Accordingly, thermal efficiency and responsiveness of the thermal head 2 can be improved by the presence of the groove 26 on the glass layer 21.

Furthermore, according to the structure of the thermal head 2, the width W1 of the groove 26 of the glass layer 21 is equivalent to the width of the heating areas 22*a* or larger than the length L1 of the heating areas 22*a*. Thus, the thickness at both ends of the heat accumulating portion 27 is reduced, and heat is not easily released from the heat accumulating portion 27. As a result, release of thermal energy generated from the heating areas 22*a* is decreased, and thermal efficiency is further improved.

Concerning thermal efficiency, since the radius of curvature R2 at both sides of the projecting portion 25 of the glass layer 21 in the thermal head 2 is smaller than the radius of curvature R1 at the central area 25*a* of the projecting portion 25, the thickness at both sides of the heat accumulating portion 27 is decreased and heat release from the heat accumulating portion 27 is further reduced. Thus, release of thermal energy generated from the heating areas 22*a* is further reduced, and thermal efficiency is further increased.

According to the structure of the thermal head 2, the groove 26 of the glass layer 21 is so formed as to extend upward substantially in the vertical direction with the circular-arc-shaped end corners 31*b* formed at the distal end 31 as illustrated in FIGS. 5A and 5B and/or to have the substantially uniform thickness T1 of the projecting portion 25 as illustrated in FIGS. 8A and 8B. Thus, physical strength can be increased. Since the glass layer 21 of the thermal head 2 has high physical strength, deformation and breakage of the glass layer 21, particularly deformation and damage of the projecting portion 25 having reduced thickness, caused by the press from the platen 5 at the time of printing are prevented even when large pressure of about 45 kg per unit area is applied to the glass layer 21.

Accordingly, the thermal head 2 has excellent thermal efficiency and responsiveness, and the glass layer 21 and the projecting portion 25 are not deformed nor damaged by the press from the platen 5. Thus, high-quality images and characters can be printed with reduced power at high speed. In addition, according to the structure of the thermal head 2, it is possible that the groove 26 is so formed that the width between the wall surfaces 30 of the groove 26 at the base end 29 is larger than the width at the distal end 31 as illustrated in FIG. 7. In this case, when the groove 26 is formed by heat pressing using a metal mold, for example, the mold can be easily separated. Thus, production efficiency increases.

Figures 11A, 11B:
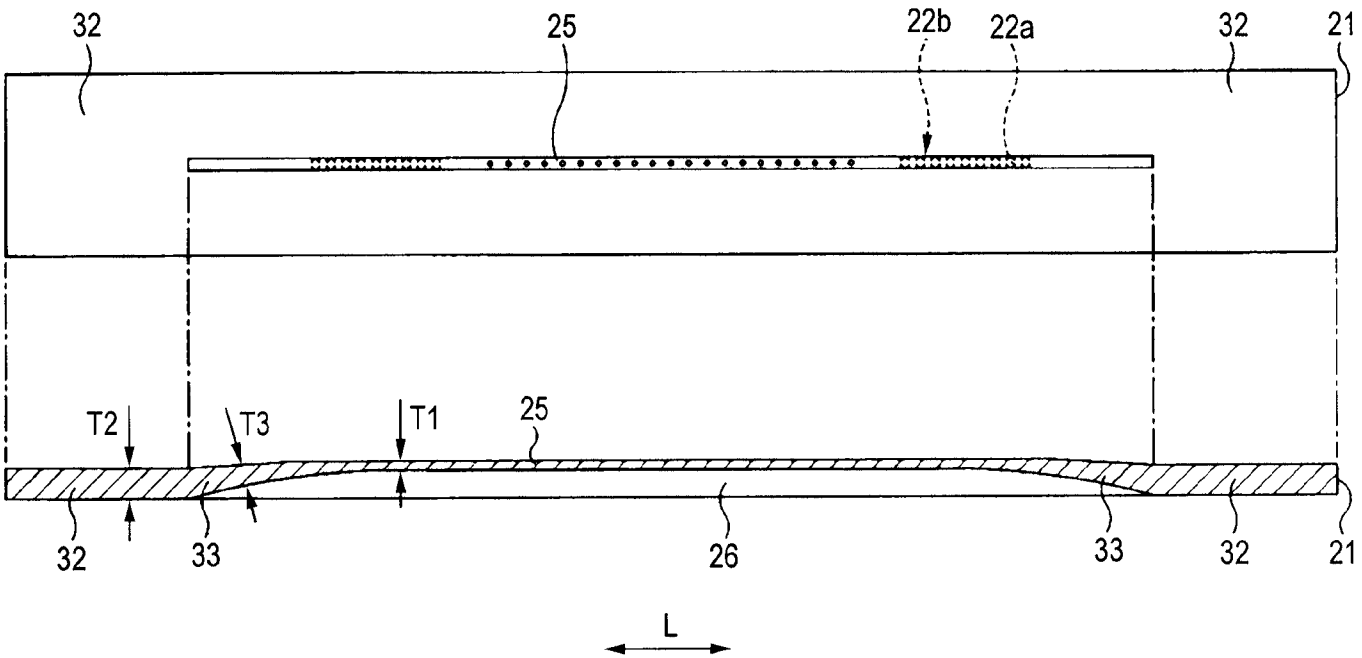
FIG. 11 is a cross-sectional view of the glass layer having reinforcing portions.
Figure 12:
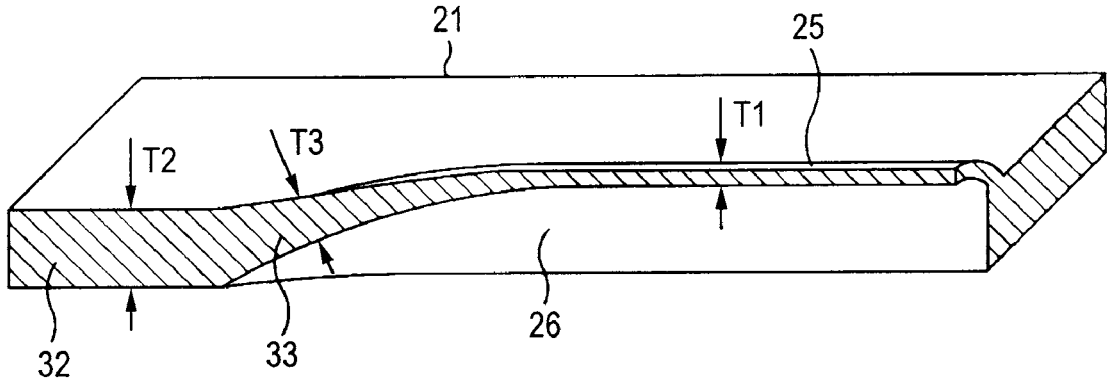
FIG. 12 is a partial cross-sectional view of the glass layer shown in FIG. 11.

As illustrated in FIGS. 11 and 12, the groove 26 of the glass layer 21 of the head 20 is provided at the position opposed to the row 22*b* of the plural heating areas 22*a* arranged substantially in a linear direction along the length of the head 20 (L direction in FIG. 11), and a first reinforcing portion 32 is provided on both sides of the groove 26 in the linear arrangement direction of the heating areas 22*a*. The first reinforcing portion 32 is formed by increasing the thickness of the glass layer 21. A thickness T2 of the first reinforcing portion 32 is larger than the thickness T1 of the projecting portion 25 (T2>T1). Since the first reinforcing portion 32 having the thickness T2 larger than the thickness T1 of the projecting portion 25 is provided on both sides of the groove 26 in the longitudinal direction, the projecting portion 25 of the glass layer 21 is reinforced. Thus, when the platen 5 presses the glass layer 21, deformation and breakage of the projecting portion 25 of the glass layer 21 caused by the press from the platen 5 can be prevented.

Additionally, as illustrated in FIGS. 11 and 12, a second reinforcing portion 33 having a thickness T3 which gradually increases from the ends of the projecting portion 25 toward the first reinforcing portion 32 is formed inside the first reinforcing portion 32 in addition to the first reinforcing portion 32. Since the second reinforcing portion 33 as well as the first reinforcing portion 32 is formed on the glass layer 21, the projecting portion 25 can be further reinforced. Thus, physical strength of the projecting portion 25 of the glass layer 21 can be increased, and deformation and breakage of the projecting portion 25 caused by the press from the platen 5 can be further securely prevented.

According to the structure of the thermal head 2, the first reinforcing portion 32 and the second reinforcing portion 33 are provided on both sides of the glass layer 21 in the linear arrangement direction of the heating areas 22*a*. Thus, physical strength of the glass layer 21 can be increased, and deformation and breakage of the glass layer 21, particularly deformation and breakage of the projecting portion 25 having a reduced thickness can be prevented even when large pressure is applied to the glass layer 21.

Figure 13:
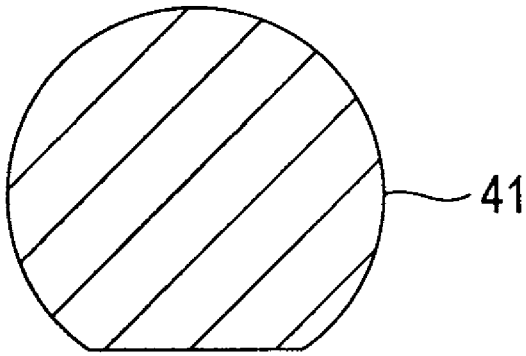
FIG. 13 is a cross-sectional view of glass as a material for the glass layer.
Figure 14:
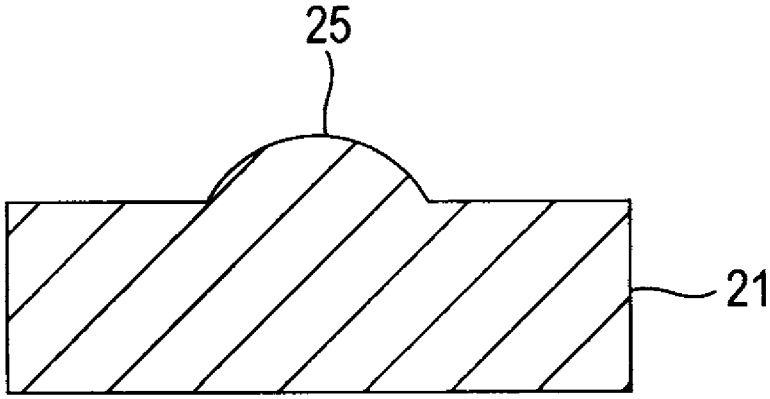
FIG. 14 is a cross-sectional view of the glass layer.

The head 20 having the glass layer 21 constructed as above is manufactured by the following method. Initially, as illustrated in FIG. 13, glass 41 as a material for the glass layer 21 is prepared. Then, as illustrated in FIG. 14, the glass layer 21 having the projecting portion 25 on the upper surface is formed from the glass 41 by heat pressing or other methods.

Subsequently, material which is highly resistant and has heat resistance is formed into a resistor film which will become the heating resistor 22 and is provided on the surface of the glass layer 21 where the projecting portion 25 is provided by using a thin film formation technology such as sputtering, though the details of this method are not shown in the figure. Material having high electric conductivity such as aluminum is formed into conductive films which will become the pair of the electrodes 23*a* and 23*b* having a predetermined thickness.

Figure 15:
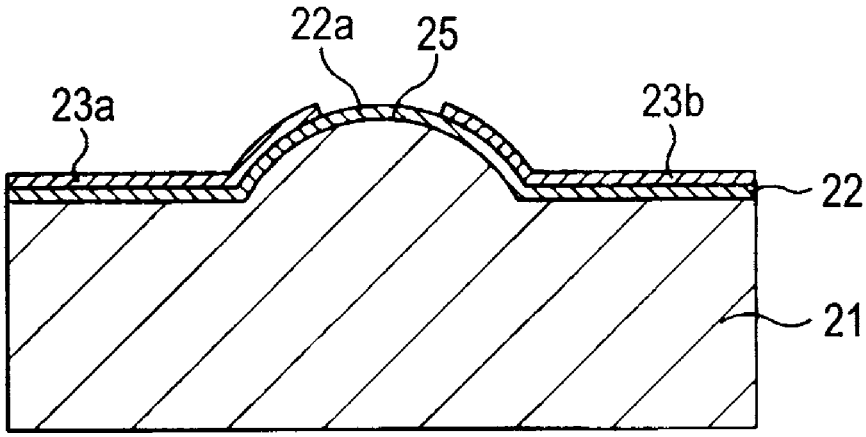
FIG. 15 is a cross-sectional view of a condition where a heating resistor and a pair of electrodes are provided on the glass layer by pattern formation.

Then, as illustrated in FIG. 15, the heating resistor 22 and the pair of the electrodes 23*a* and 23*b* are formed by pattern formation using a pattern formation technology such as photolithography, and the heating resistor 22 is exposed between the pair of the electrodes 23*a* and 23*b* to form the heating areas 22*a*. The glass layer 21 is exposed in the areas where the heating resistor 22 and the pair of the electrodes 23*a* and 23*b* are not formed.

Figure 16:
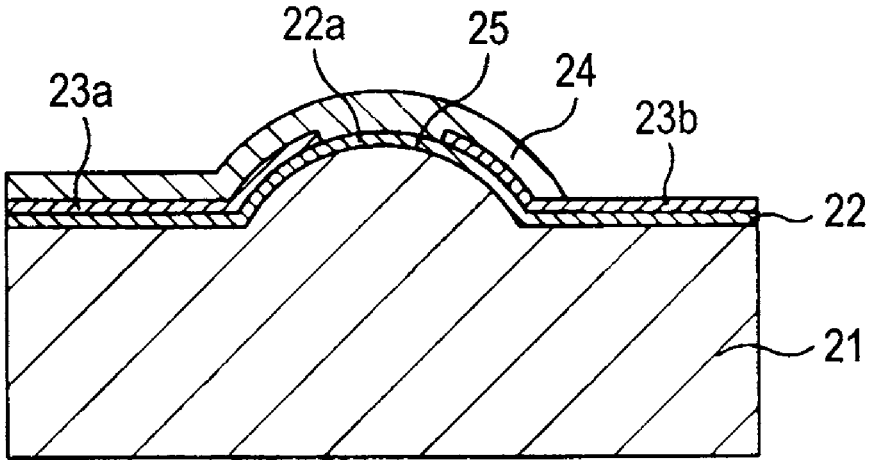
FIG. 16 is a cross-sectional view showing a condition where a resistor protecting layer is provided over the heating resistor and the pair of the electrodes.

Next, as illustrated in FIG. 16, SIALON or other material is formed into the resistor protecting layer 24 having a predetermined thickness and provided on the heating resistor 22 and the pair of the electrodes 23*a* and 23*b* by a thin film formation technology such as sputtering.

Figure 17:
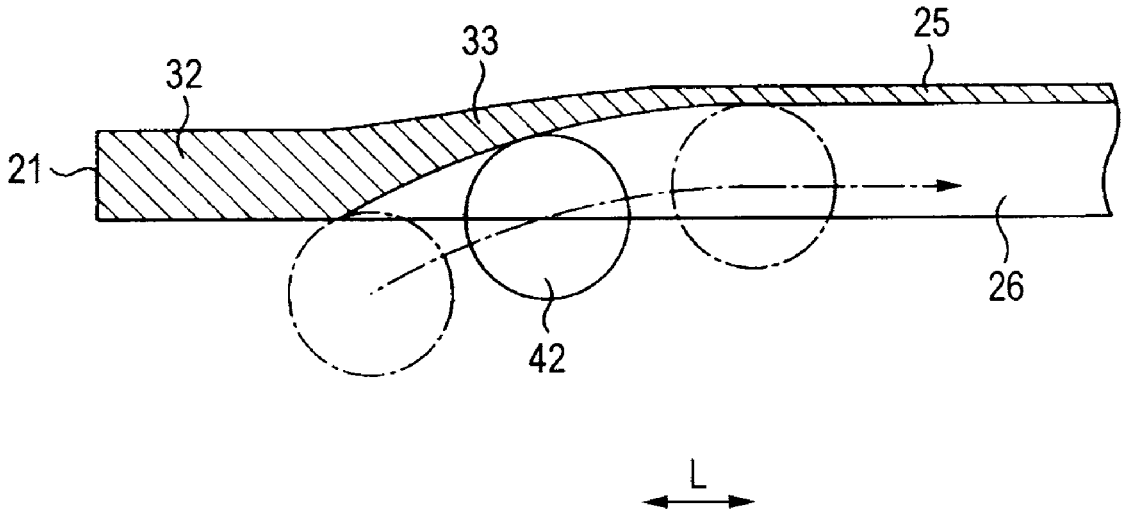
FIG. 17 is a partial cross-sectional view of a condition where the groove is formed by a cutter.

Subsequently, as illustrated in FIG. 17, the concave groove 26 is formed on the surface of the glass layer 21 opposite to the surface where the projecting portion 25 has been formed, that is, the surface which becomes the inner surface of the thermal head 2 at the position opposed to the row 22*b* of the heating areas 22*a* by cutting using a cutter 42, thereby completing manufacture of the head 20. By using the cutter 42 for forming the groove 26, the first reinforcing portion 32 and the second reinforcing portion 33 can be formed on the glass layer 21 by a series of cutting steps as illustrated in FIG. 17.

Hydrofluoric acid treatment may be applied to the inner surface of the groove 26 after forming the groove 26 by cutting so as to remove flaws given to the inner surface of the groove 26. The groove 26 may be formed by other methods such as etching or heat pressing other than mechanical processing such as cutting.

In the case of forming the groove 26 shown in FIG. 7 which has the wall surfaces 30 expanding from the distal end 31 toward the base end 29, the groove 26 may be formed by heat pressing using a metal mold since the metal mold can be easily separated. When the groove 26 is formed by heat pressing, the groove 26 may be formed simultaneously with the formation of the projecting portion 25 by using the upper mold for the projecting portion 25 and the lower mold for the groove 26.

Figure 20:
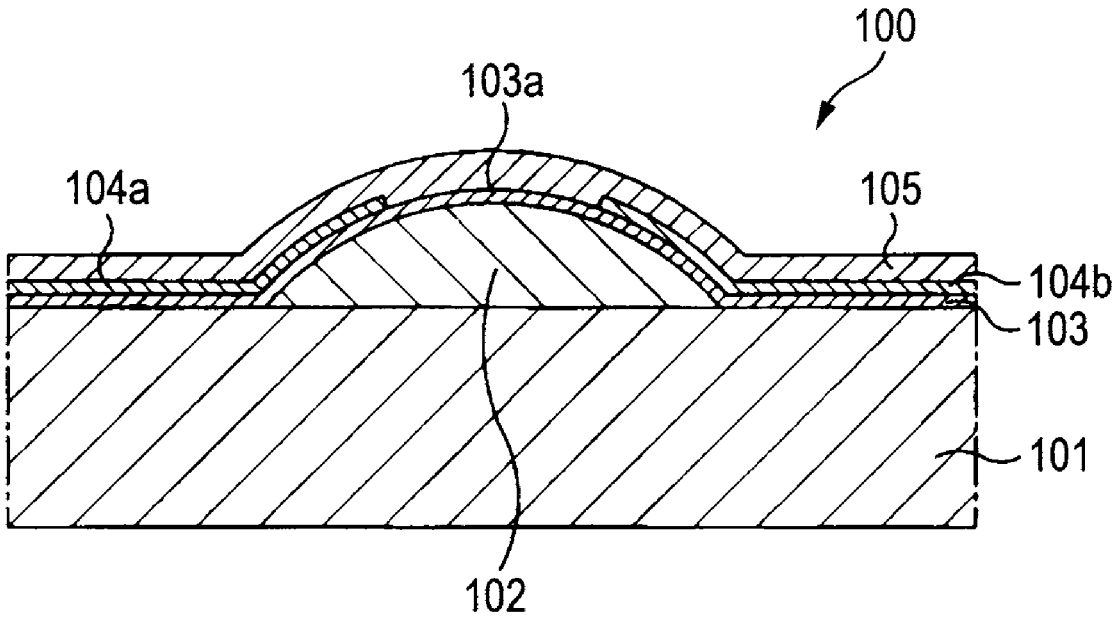
FIG. 20 is a cross-sectional view of a thermal head in related art.
Figure 21:
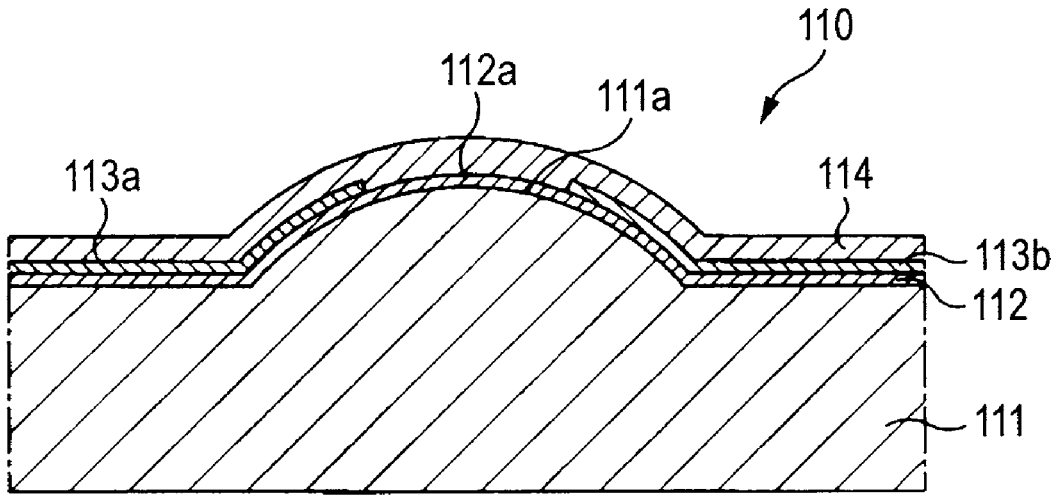
FIG. 21 is a cross-sectional view of the thermal head shown as an art related to the embodiment of the invention.
Figure 22:
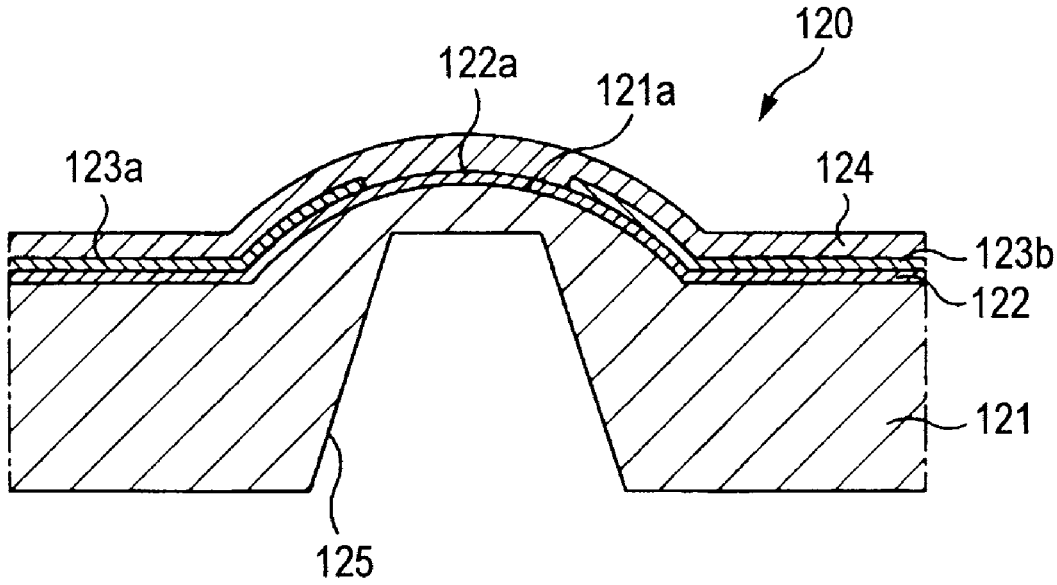
FIG. 22 is a cross-sectional view of the thermal head shown as another art related to the embodiment of the invention.
Figure 23:
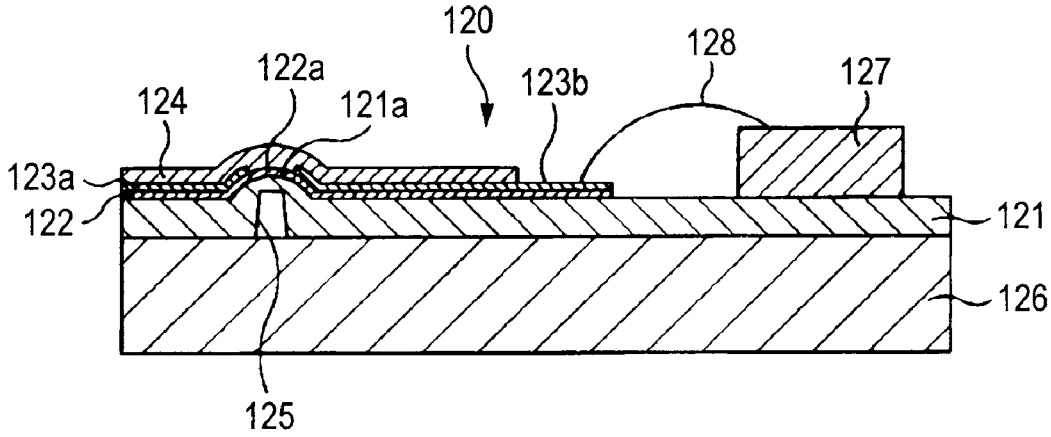
FIG. 23 is a cross-sectional view showing a condition where the thermal head shown in FIG. 22 is disposed on a heat release member with a semiconductor chip provided on a glass layer.
Figure 24:
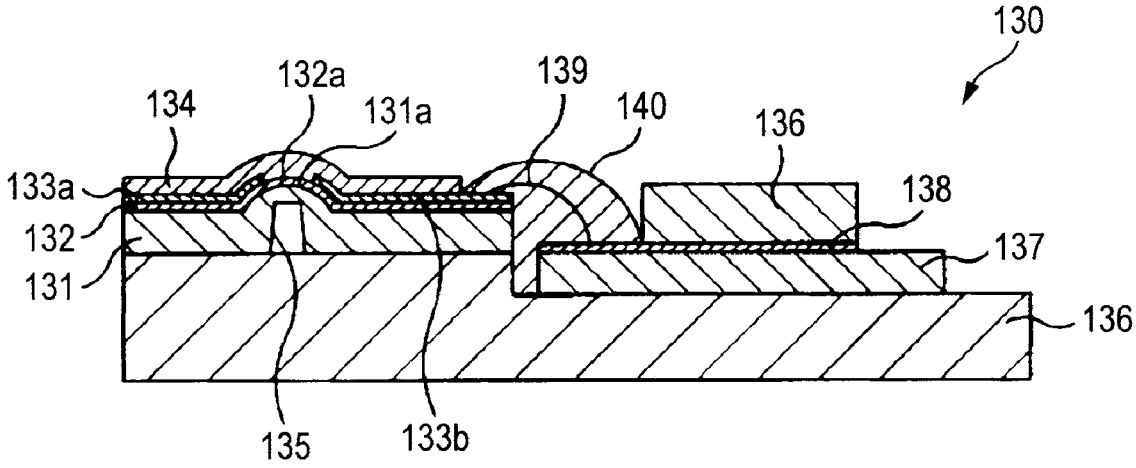
FIG. 24 is a cross-sectional view showing a condition where the thermal head shown as the art related to the embodiment of the invention and a semiconductor chip provided on a rigid substrate are electrically connected by wire bonding.

Since the entire structure of the head 20 is formed by the glass layer 21 without using a ceramic substrate, the number of components not including the ceramic substrate is smaller than the number of components of the thermal head 100 which uses the ceramic substrate 101 shown in FIG. 20. Thus, the structure of the head 20 can be simplified. Accordingly, production efficiency of the thermal head 2 can be improved by the reduction of the number of components.

Figure 18:
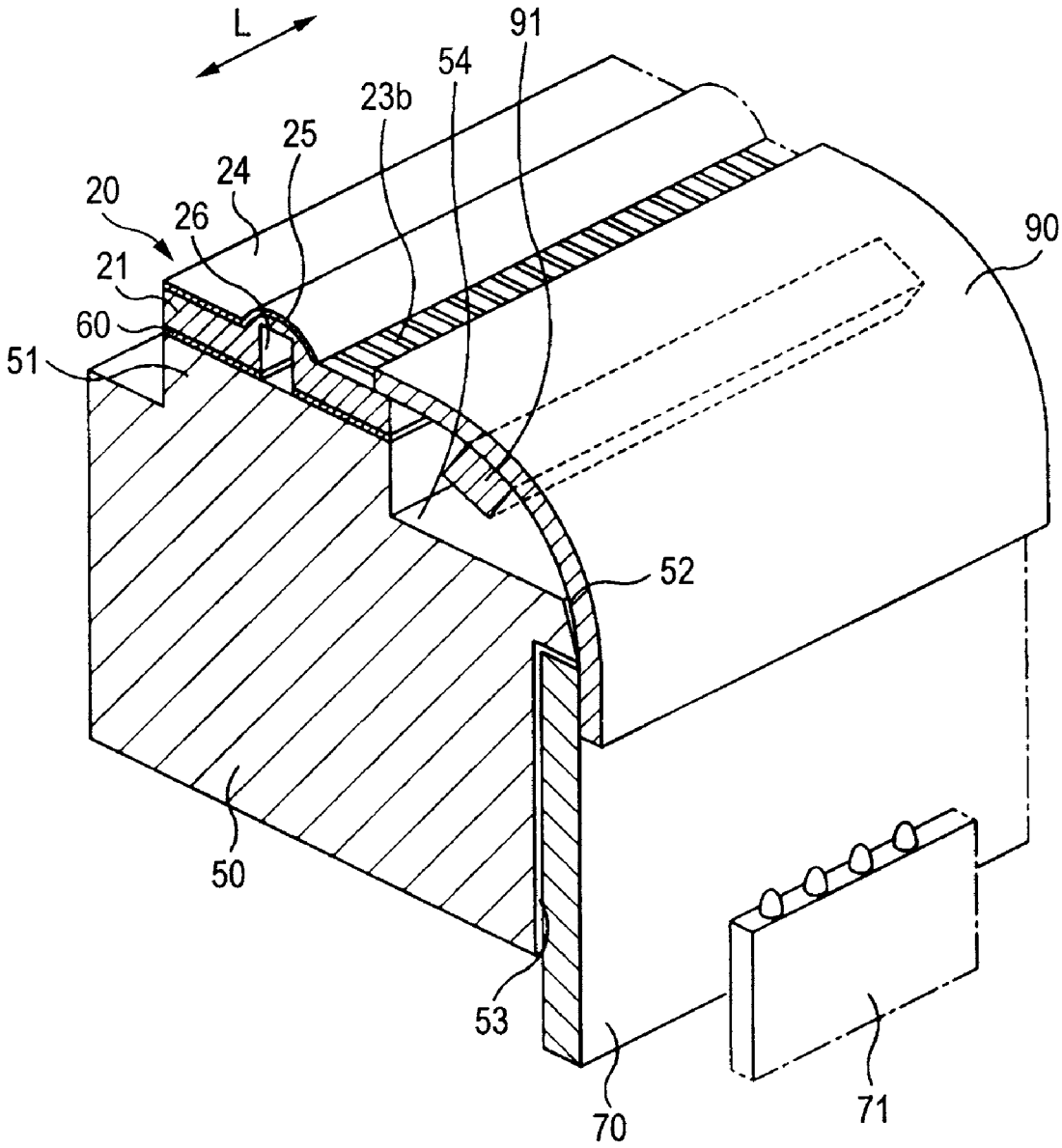
FIG. 18 is a partial perspective view of the thermal head.

As illustrated in FIGS. 3 and 18, the thermal head 2 having the head 20 thus constructed is disposed on the heat release member 50 via an adhesive layer 60. The head 20 and the rigid substrate 70 having the control circuit for the head 20 and the like are electrically connected by the power supply flexible substrate 80 and the signal flexible substrates 90. According to the structure of the thermal head 2, the rigid substrate 70 is brought to a position facing the side of the heat release member 50 by bending the power supply flexible substrate 80 and the signal flexible substrates 90 toward the heat release member 50.

The heat release member 50 efficiently releases thermal energy generated from the head 20 at the time of thermal transfer of the color material, and is made of material having high heat conductivity such as aluminum. As illustrated in FIGS. 3 and 18, an attachment projection 51 to which the heat 20 is attached is formed on the upper surface of the heat release member 50 substantially at the center in the width direction throughout the length of the heat release member 50 (L direction in FIG. 18). A taper 52 for bending the power supply flexible substrate 80 and the signal flexible substrates 90 along the side of the heat release member 50 is provided at the upper end of the side of the heat release member 50 facing to the bent areas of the power supply flexible substrate 80 and the signal flexible substrates 90. A first notch 53 for positioning the rigid substrate 70 along the side of the heat release member 50 is formed at the lower end of the taper 52. Also, a second notch 54 is formed on the heat release member 50 so that semiconductor chips 91 to be described later formed on the signal flexible substrates 90 can be disposed at positions facing to the heat release member 50.

Figure 19:
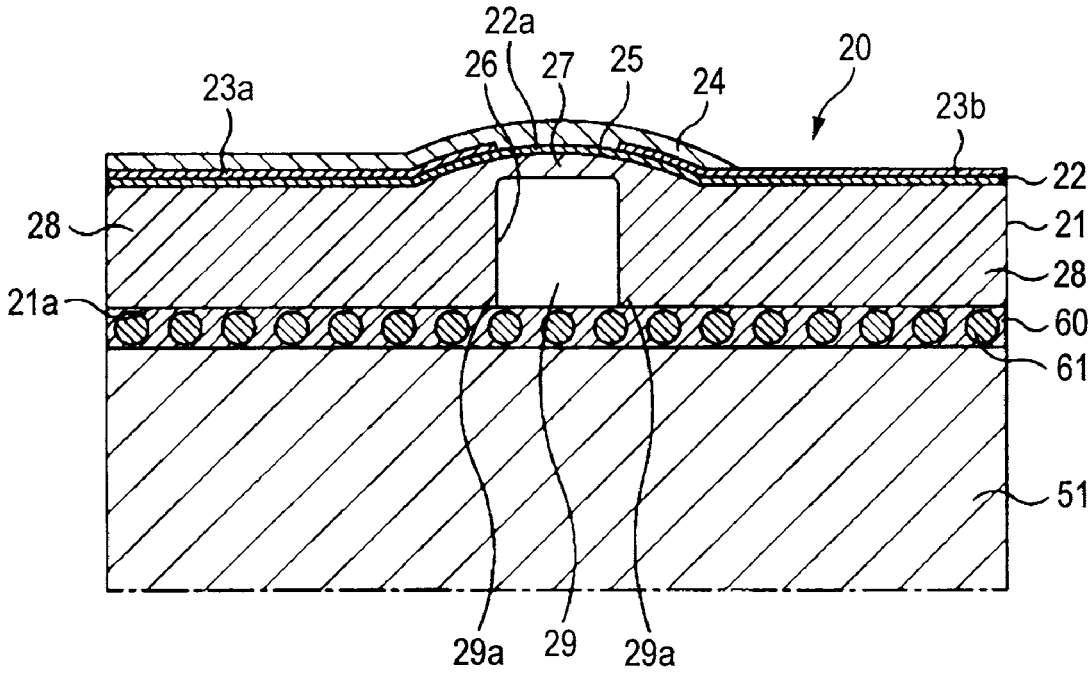
FIG. 19 is a cross-sectional view showing a condition where the glass layer is bonded to a heat release member by an adhesive layer.

As illustrated in FIG. 19, the head 20 is attached to the attachment projection 51 of the heat release member 50 via the adhesive layer 60. The adhesive layer 60 is formed by adhesive having thermal conductivity and elasticity. Since the adhesive layer 60 has thermal conductivity, the adhesive layer 60 can efficiently release heat generated from the head 20 to the heat release member 50. Since the adhesive layer 60 has elasticity, the head 20 is not separated from the heat release member 50 by the heat release from the head 20 even when the head 20 and the heat release member 50 differently expand or contract due to different coefficients of thermal expansion of the heat release member 50 and the head 20. The thickness of the adhesive layer 60 is about 50 μm, for example.

As illustrated in FIG. 19, the adhesive layer 60 is made of resin having thermal conductivity such as hot setting type and liquid silicone rubber, and contains fillers 61 having high hardness and thermal conductivity. The fillers 61 contained in the adhesive layer 60 are particulate or linear fillers such as aluminum oxide. The fillers 61 contained in the adhesive layer 60 function as spacers between the head 20 and the heat release member 50. The fillers 61 are not contracted by the head 20 pressed by the platen 5, and maintain a constant thickness of the adhesive layer 60 while preventing depression of the ends 29*a* at the base end 29 of the glass layer 21 toward the heat release member 50. Since the adhesive layer 60 keeps its thickness constant by the fillers 61, pressure applied from the projecting portion 25 to the ends 29*a* at the base end 29 of the groove 26 at the time of the press of the platen 5 against the head 20 is dispersed to the bottom surface 21*a* of the glass layer 21 and received by the entire bottom surface 21*a* of the glass layer 21. Furthermore, in the adhesive layer 60, the pressure applied from the platen 5 is released in a direction parallel with the bottom surface 21*a* by the rolling movement of the fillers 61.

Accordingly, depression of the glass layer 21 of the thermal head 2 toward the heat release member 50 is prevented even when large pressure is applied from the platen 5 to the glass layer 21, and therefore deformation and breakage of the glass layer 21 is prevented.

The fillers 61 contained in the adhesive layer 60 may have a diameter equal to or larger than the thickness of the adhesive layer 60. According to the adhesive layer 60 which contains the fillers 61 having the thickness equivalent to or larger than the thickness of the adhesive layer 60, the adhesive layer 60 is not constricted by the head 20 due to the presence of the fillers 61 at the time of the press of the platen 5 against the head 20. Thus, the thickness of the adhesive layer 60 can be more securely maintained, and deformation and breakage of the glass layer 21 can be more securely prevented.

A not-shown power supply line for supplying current from the power source to the head 20, and a not-shown control circuit for controlling the operation of the head 20 on which a plurality of electronic components are mounted are provided on the rigid substrate 70 disposed facing to the side of the heat release member 50 shown in FIG. 3. As illustrated in FIG. 3, flexible substrates 71 as power supply lines and signal lines are electrically connected with the rigid substrate 70. The rigid substrate 70 is disposed in the first notch 53 formed on the side of the heat release member 50. Both ends of the rigid substrate 70 are fixed to the heat release member 50 by fixing members 72 such as screws.

As illustrated in FIGS. 3 and 6, one end of the power supply flexible substrate 80 electrically connected with the rigid substrate 70 is electrically connected with the not-shown power supply line of the rigid substrate 70, and the other end is electrically connected with the common electrode 23*a* of the head 20 so as to electrically connect the common electrode 23*a* of the head 20 and the line of the rigid substrate 70 and supply current to the respective heating areas 22*a*. The power supply flexible substrate 80 may electrically connect with the common electrode 23*a* via a film made of insulating resin material containing conductive particles such as anisotropic conductive film (ACF) interposed between the power supply flexible substrate 80 and the common electrode 23*a*. Since the power supply flexible substrate 80 and the common electrode 23*a* are electrically connected via the ACF, release of thermal energy generated from the heating areas 22*a* toward the power supply flexible substrate 80 via the common electrode 23*a* is prevented.

As illustrated in FIGS. 3 and 6, one end of each of the signal flexible substrates 90 is electrically connected with the not-shown control circuit on the rigid substrate 70, and the other end is electrically connected with the corresponding discrete electrodes 23*b* of the head 20. The signal flexible substrates 90 are plural and disposed in parallel with one another along the length of the thermal head 2 (L direction in FIG. 3).

As illustrated in FIGS. 6 and 18, the semiconductor chip 91 having driving circuits for driving the corresponding heating areas 22*a* of the head 20 is provided on one surface of each of the signal flexible substrates 90. A connecting terminal 92 for electrically connecting the semiconductor chip 91 and the corresponding discrete electrodes 23*b* is provided on each connecting side of the same surfaces of the signal flexible substrates 90 connected with the head 20.

As illustrated in FIG. 18, the semiconductor chip 91 provided on each of the signal flexible substrates 90 is disposed on the inner side of the signal flexible substrate 90. As illustrated in FIG. 6, each of the semiconductor chips 90 has a shift register 93 for converting a serial signal corresponding to printing data given from the control circuit of the rigid substrate 70 into a parallel signal, and switching elements 94 for controlling heat generation from the heating areas 22*a*. The shift register 93 converts the serial signal corresponding to the printing data into the parallel signal and latches the converted parallel signal. Each of the switching elements 94 is provided for the corresponding discrete electrode 23*b* equipped on the corresponding heating area 22*a*. The parallel signal latched by the shift register 93 controls on and off of the switching elements 94 to control heat generation from the heating areas 22*a* by controlling current supply, supply time and other conditions for the respective heating areas 22*a*.

As illustrated in FIG. 6, each of the connecting terminals 92 is provided for the corresponding discrete electrodes 23*b* which are equipped for the heating areas 22*a* with one-to-one correspondence to electrically connect the discrete electrodes 23*b* and the semiconductor chip 91. As illustrated in FIG. 4, a film 95 such as an anisotropic conductive film (ACF) is interposed between the glass layer 21 on the discrete electrodes 23*b* side and the signal flexible substrate 90 such that the connecting terminals 92 and the discrete electrodes 23*b* are electrically connected via the ACF. According to the structure of the thermal head 2, since the discrete electrodes 23*b* of the head 20 and the signal flexible substrates 90 are connected by the ACF made of insulating resin material, release of thermal energy generated from the heating areas 22*a* toward the signal flexible substrate 90 via the discrete electrodes 23*b* is prevented even when the signal flexible substrates 90 are connected in the vicinity of the heating areas 22*a*. Thus, thermal efficiency is not decreased. Accordingly, in the structure of the thermal head 2 in which the groove 26 is formed on the glass layer 21 of the head 20 and the discrete electrodes 23*b* and the signal flexible substrates 90 are connected by the ACF, release of thermal energy generated from the heating areas 22*a* is further reduced, and thermal efficiency is further increased. Since release of thermal energy from the heating areas 22*a* toward the signal flexible substrates 90 via the discrete electrodes 23*b* is prevented by the ACF connection in the thermal head 2, the semiconductor chips 91 provided on the signal flexible substrates 90 can be protected from heat.

Electrical connection between the connecting terminals 92 and the discrete electrodes 23*b* may be made by material which contains resin and has low thermal conductivity such as conductive paste in lieu of the film 95 such as ACF. The semiconductor chips 91 of the thermal head 2 may be disposed outside.

An insulating component may be interposed between the heat release member 50 and the parts of the rigid substrate 70, the power supply flexible substrate 80, and the signal flexible substrates 90 in the thermal head 2 so as to prevent electrical contact and mechanical contact between the heat release member 50 and the semiconductor chips 91 and between the rigid substrate 70 and the heat release member 50.

According to the thermal head 2 thus constructed, the semiconductor chips 91 having the shift registers 93 for converting the serial signal into parallel signal are provided on the signal flexible substrates 90 which electrically connect the discrete electrodes 23*b* of the head 20 and the control circuit of the rigid substrate 70. Thus, serial transmission between the rigid substrate 70 and the signal flexible substrates 90 can be achieved, resulting in reduction of the number of electrical connections.

Since the head 20 and the rigid substrate 70 are connected by the power supply flexible substrate 80 and the signal flexible substrates 90 in the thermal head 2 having the above structure, the rigid substrate 70 can be disposed at arbitrary positions around the head 20. As illustrated in FIGS. 3 and 18, the semiconductor chips 91 of the thermal head 2 are opposed to the second notch 54 formed on the heat release member 50. The power supply flexible substrate 80 and the signal flexible substrates 90 are curved along the taper 52 of the heat release member 50 such that the semiconductor chips 91 are located inside. The rigid substrate 70 is disposed in the first notch 53 of the heat release member 50. Since the rigid substrate 70 is positioned facing to the side of the heat release member 50, the thermal head 2 is made compact, resulting in reduction of the entire size of the printer 1. Accordingly, the printer 1 including the thermal head 2 can be made compact, which has been demanded especially for household printers.

According to the structure of the thermal head 2, the head 20 is equipped on the heat release member 50 via the adhesive layer 60. Thus, the structure is simplified and easily manufactured, resulting in increase of production efficiency. Since the semiconductor chips 91 are disposed on the inner side of the thermal head 2, the semiconductor chips 91 can be protected from static electricity.

In the structure of the thermal head 2 miniaturized by disposing the semiconductor chips 91 inside and the rigid substrate 70 facing to the side of the heat release member 50, the ribbon guide 6*a* on the entrance side of the printing medium 4 can be positioned close to the thermal head 2 as illustrated in FIGS. 1 and 2. In the structure of the printer 1 having the thermal head 2, therefore, the ink ribbon 3 and the printing medium 4 can be guided to a position immediately before entrance into the space between the thermal head 2 and the platen 5, and thereby the ink ribbon 3 and the printing medium 4 can appropriately enter between the thermal head 2 and the platen 5. Since the ink ribbon 3 and the printing medium 4 enter between the thermal head 2 and the platen 5 in a proper manner in the printer 1, the ink ribbon 3 and the printing medium 4 contact the thermal head 2 substantially in the vertical direction, allowing thermal energy from the thermal head 2 to be appropriately applied to the ink ribbon 3. In addition, the size reduction of the thermal head 2 increases the degree of freedom in designing the moving paths of the ink ribbon 3 and the printing medium 4 which move near the thermal head 2.

Since the semiconductor chips 91 are equipped on the signal flexible substrates 90 in the thermal head 2, the necessity for providing the semiconductor chips 91 on the glass layer 21 of the head 20 is eliminated. Thus, the size of the glass layer 21 is reduced and the cost is lowered.

According to the printer 1 having the thermal head 2 thus constructed, the ink ribbon 3 and the printing medium 4 move between the thermal head 2 and the platen 5 while being pressed onto the thermal head 2 by the platen 5 at the time of printing images and characters as illustrated in FIGS. 1 and 2.

During this process, large force of about 45 kg per unit area is applied to the thermal head 2 by the platen 5. However, as discussed above, physical strength is increased by forming the groove 26 extending upward substantially in the vertical direction with the circular-arc-shaped corners 31*b* at the distal end 31 on the glass layer 21 as illustrated in FIGS. 5A and 5B, by forming the projecting portion 25 having the substantially uniform thickness T1 as illustrated in FIGS. 8A and 8B, by forming the first reinforcing portion 32 and the second reinforcing portion 33 at both ends of the head 20 in the longitudinal direction as illustrated in FIG. 11, and by inserting fillers into the adhesive layer 60 formed between the head 20 and the heat release member 50. Thus, deformation and breakage of the glass layer 21 caused by the press from the platen 5 can be prevented.

Then, the color material of the ink ribbon 3 is thermally transferred onto the printing medium 4 moving between the thermal head 2 and the platen 5. During thermal transfer of the color material, the serial signal corresponding to the printing data given from the control circuit of the rigid substrate 70 is converted into the parallel signal by the shift registers 93 of the semiconductor chips 91 provided on the signal flexible substrates 90. The converted parallel signal is latched, and on and off time of the switching element 94 provided for each of the discrete electrodes 23*b* is controlled based on the latched signal. According to the thermal head 2, when the switching element 94 is turned on, current flows in the heating area 22*a* connected with this switch element 94 for a predetermined period of time. As a result, the heating area 22*a* generates heat and applies generated thermal energy to the ink ribbon 3, thereby sublimating the color material and thermally transferring the color material on the printing medium 4. When the switching element 94 is turned off, current does not flow in the heating area 22*a* connecting with this switching element 94 and no heat is generated from the heating area 22*a*. Since thermal energy is not applied to the ink ribbon 3, the color material is not transferred to the printing medium 4. According to the printer 1, serial signals per line of printing data are transmitted from the control circuit of the thermal head 2 to the semiconductor chips 91 of the signal flexible substrate 90, and the above operations are repeated to thermally transfer yellow on the image forming area. After thermal transfer of yellow, magenta, cyan, and the laminate film are sequentially transferred by heat so that an image corresponding one sheet can be printed.

Since the groove 26 having the width W1 equivalent to or larger than the length L1 of the heating areas 22*a* is formed on the glass layer 21 of the head 20 in the thermal head 2, thermal energy generated from the heat areas 22*a* is not easily released toward the glass layer 21 during thermal transfer of the color material on the ink ribbon 3. Thus, thermal energy accumulated on the heat accumulating portion 27 of the glass layer 21 is not easily released to the surrounding area 28 of the groove 26, resulting in increase of the quantity of heat supplied to the ink ribbon 3. Since the radius of curvature R2 at the sides 25*b* of the projecting portion 25 of the glass layer 21 is smaller than the radius of curvature R1 at the central area 25*a* of the projecting portion 25 in the thermal head 2, release of thermal energy accumulated on the heat accumulating portion 27 to the surrounding area 28 is further reduced. Thus, the temperature of the heating portions 22*a* can be easily increased by utilizing the thermal energy accumulated on the heat accumulating portion 27 of the glass layer 21 in the thermal head 2. Accordingly, thermal efficiency of the thermal head 2 can be improved. Moreover, since the groove 26 is formed on the glass layer 21 in the thermal head 2, the quantity of accumulated heat on the glass layer 21 is decreased. Thus, the temperature promptly drops when the heating areas 22*a* do not generate heat, which enhances responsiveness. Accordingly, the printer 1 having improved thermal efficiency and responsiveness can print high-quality images and characters with reduced power at high speed.

As obvious from above, according to the thermal head 2 which is made compact, deformation and breakage of the glass layer 21 caused by the press from the platen 5 is prevented, and thermal efficiency and responsiveness are improved. Thus, the printer 1 used as a household device can print high-quality images and characters with reduced power at high speed.

In this embodiment, the thermal head 2 is included in the household printer 1 used for printing post cards. However, the thermal head 2 can be employed for printers for business use as well as the household printer 1. The size of the printing medium is not limited to that of post cards, but may be L-size photo sheets, ordinary sheets or the like. In the case of these printing media, the printer including the thermal head 2 can similarly print at high speed.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal head, comprising:

a head which includes (a) a glass layer containing a projecting portion on one surface and a concave groove on the other surface at a position opposed to the projecting portion, (b) a heating resistor disposed on the projecting portion, and (c) a pair of electrodes disposed on both sides of the heating resistor;

a rigid substrate on which a control circuit for the head is provided; and a flexible substrate for electrically connecting the head and the rigid substrate, wherein, the electrodes of the head and connection terminals of the flexible substrate are electrically connected by resin containing conductive particles.

2. The thermal head according to claim 1, wherein:

the head is disposed on a heat release member; and the flexible substrate is bent so that the rigid substrate can be disposed along the side of the heat release member.

3. A printer comprising:

a thermal head which includes (A) a head which contains (1) a glass layer having a projecting portion on one surface and a concave groove on the other surface at a position opposed to the projecting portion, (2) a heating resistor disposed on the projecting portion, and (3) a pair of electrodes disposed on both sides of the heating resistor, (B) a rigid substrate on which a control circuit for the head is provided, and (C) a flexible substrate for electrically connecting the head and the rigid substrate, wherein, the electrodes of the head and connection terminals of the flexible substrate are electrically connected by resin containing conductive particles.

4. A thermal head disposed at a position opposed to a platen such that an ink ribbon and a printing medium can move between the platen and the thermal head for thermally transferring color material of the ink ribbon onto the printing medium by applying thermal energy to the ink ribbon, the thermal head comprising:

a head which includes (a) a glass layer having a projecting portion on one surface and a concave groove on the other surface at a position opposed to the projecting portion, (b) a heating resistor disposed on the projecting portion, and (c) a pair of electrodes disposed on both sides of the heating resistor;

a heat release member on which the head is provided;

a rigid substrate on which a control circuit for the head is provided; and a flexible substrate for electrically connecting the head and the rigid substrate, wherein, a semiconductor chip having driving a circuit for driving the heating resistor is mounted on one of the surfaces of the flexible substrate, the semiconductor chip is disposed on the inner surfaces of the bent flexible substrate, and the flexible substrate is bent so that the rigid substrate can be disposed along the side of the heat release member.

5. The thermal head according to claim 4, wherein:

the semiconductor chip has a shift register for converting a serial signal given from the control circuit on the rigid substrate into a parallel signal; and a corresponding number of the flexible substrate to the number of electrodes which are provided for the heating resistor with one-to-one correspondence are disposed on the connecting side of the head and have connection terminals for outputting the parallel signal.

6. A printer comprising a thermal head disposed at a position opposed to a platen such that an ink ribbon and a printing medium can move between the platen and the thermal head for thermally transferring color material of the ink ribbon onto the printing medium by applying thermal energy to the ink ribbon, the thermal head including:

(A) a head which includes (1) a glass layer having a projecting portion on one surface and a concave groove on the other surface at a position opposed to the projecting portion, (2) a heating resistor disposed on the projecting portion, and (3) a pair of electrodes disposed on both sides of the heating resistor;

(B) a heat release member on which the head is provided;

(C) a rigid substrate on which a control circuit for the head is provided; and (D) a flexible substrate for electrically connecting the head and the rigid substrate, wherein, a semiconductor chip having a driving circuit for driving the heating resistor is mounted on one of the surfaces of the flexible substrate, the semiconductor chip is disposed on the inner surfaces of the bent flexible substrate, and the flexible substrate is bent so that the rigid substrate can be disposed along the side of the heat release member.

* * * * *